US006963714B2

(12) United States Patent
Otomo et al.

(10) Patent No.: US 6,963,714 B2
(45) Date of Patent: Nov. 8, 2005

(54) DEVELOPING BLADE AND DEVICE AND PROCESS CARTRIDGE

(75) Inventors: Yasunao Otomo, Mishima (JP); Kazumi Yamauchi, Shizuoka-ken (JP); Norihito Naito, Numazu (JP); Hideaki Hasegawa, Susono (JP); Nobuo Oshima, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 52 days.

(21) Appl. No.: 10/702,445

(22) Filed: Nov. 7, 2003

(65) Prior Publication Data

US 2004/0131393 A1 Jul. 8, 2004

(30) Foreign Application Priority Data

Nov. 7, 2002 (JP) ..... 2002-323747

(51) Int. Cl.[7] ..... G03G 15/09
(52) U.S. Cl. ..... 399/274
(58) Field of Search ..... 399/98, 102, 103, 399/104, 105, 274, 284

(56) References Cited

U.S. PATENT DOCUMENTS

| | | | | |
|---|---|---|---|---|
| 4,528,936 | A * | 7/1985 | Shimazaki et al. | 399/284 |
| 5,084,733 | A * | 1/1992 | Katoh et al. | 399/104 |
| 5,134,960 | A * | 8/1992 | Shirai | 399/105 |
| 5,338,895 | A * | 8/1994 | Ikegawa et al. | 399/284 X |
| 5,592,268 | A * | 1/1997 | Uehara et al. | 399/103 X |
| 5,648,838 | A * | 7/1997 | Michlin et al. | 399/284 X |
| 5,790,923 | A * | 8/1998 | Oguma et al. | 399/104 X |
| 6,070,037 | A * | 5/2000 | Sugihara et al. | 399/274 |
| 6,205,304 | B1 * | 3/2001 | Kawaguchi | 399/103 |
| 6,349,184 | B2 | 2/2002 | Otomo | 399/27 |
| 6,549,223 | B2 | 4/2003 | Yamauchi | 347/132 |
| 6,615,001 | B2 | 9/2003 | Otomo et al. | 399/27 |
| 6,621,989 | B2 | 9/2003 | Otomo et al. | 399/27 |
| 6,661,980 | B2 | 12/2003 | Matsumoto et al. | 399/27 |
| 2002/0025176 | A1 | 2/2002 | Sakurai et al. | 399/25 |
| 2002/0057916 | A1 | 5/2002 | Yamuchi | 399/12 |
| 2002/0110383 | A1 | 8/2002 | Kikuchi et al. | 399/103 |
| 2003/0123888 | A1 | 7/2003 | Naito et al. | 399/27 |
| 2003/0165344 | A1 | 9/2003 | Ohtomo et al. | 399/27 |

FOREIGN PATENT DOCUMENTS

| | | |
|---|---|---|
| JP | 2001-350344 | 12/2001 |
| JP | 2002-236419 | 8/2002 |

* cited by examiner

*Primary Examiner*—Sandra L. Brase
(74) *Attorney, Agent, or Firm*—Fitzpatrick, Cella, Harper & Scinto

(57) ABSTRACT

A developing blade member for regulating a thickness of a layer of a developer on a peripheral surface of a rotatable developing roller enclosing a magnet roller, wherein a scraper for scraping the developer toward longitudinally inside of the developing roller is provided at a longitudinal end of the developing roller, the developing blade member including an elastic member for regulating the thickness of the layer of the developer on the peripheral surface of the developing roller; a metal plate for supporting the elastic member; a projection projecting toward the developing roller, the projection being provided at each of longitudinal ends of the metal plate, wherein an inside end of the projection, with respect to the longitudinal direction of the developing roller, is disposed inside of an inside end of the scraper and in a non-image-formation region.

9 Claims, 24 Drawing Sheets

( AFTER 10000 PRINTS )

(a)

| Z(mm) \ L(mm) | 0.0 | 0.3 | 0.5 | 1.0 | 1.5 |
|---|---|---|---|---|---|
| −0.1 | × | × | × | × | △ |
| 0.0 | × | △ | △ | △ | △ |
| 0.1 | × | △ | ○ | ◎ | ◎ |
| 0.2 | × | △ | ○ | ◎ | ◎ |
| 0.5 | × | △ | ○ | ◎ | ◎ |

(b)

| Z(mm) \ L(mm) | 0.0 | 0.3 | 0.5 | 1.0 | 1.5 |
|---|---|---|---|---|---|
| −0.1 | 5 | 8 | 10 | 12 | 13 |
| 0.0 | 5 | 10 | 12 | 13 | 14 |
| 0.1 | 6 | 12 | 15 | 18 | 20 |
| 0.2 | 6 | 13 | 17 | 22 | 23 |
| 0.5 | 7 | 14 | 20 | 25 | 25 |

(c)

(a)

| L(mm) | 0.0 | 0.3 | 0.5 | 1.0 | 1.5 |
|---|---|---|---|---|---|
| MAG-FORCE (G) | 3 | 10 | 15 | 18 | 20 |
| RESULTS | × | △ | ○ | ◎ | ◎ |

(b)

(a)

| L(mm) | 0.0 | 0.3 | 0.5 | 1.0 | 1.5 |
|---|---|---|---|---|---|
| MAG-FORCE (G) | 3 | 10 | 16 | 18 | 22 |
| RESULTS | × | △ | ○ | ◎ | ◎ |

(b)

( INITIAL STATE )

( AFTER 3000 PRINTS )

( AFTER 10000 PRINTS )

DEVELOPING BLADE AND DEVICE AND PROCESS CARTRIDGE

FIELD OF THE INVENTION AND RELATED ART

The present invention relates to a development blade for regulating the developer on a rotatable development roller, a developing apparatus employing said development blade, and a process cartridge employing said development blade.

Here, a developing apparatus means an apparatus having a minimum of a developing means, and removably mountable in the main assembly of an electrophotographic image forming apparatus.

A process cartridge means a cartridge in which at least a developing means and an image bearing member are integrally disposed, and which is removably mountable in the main assembly of an electrophotographic image forming apparatus An electrophotographic image forming apparatus means an apparatus which forms an image on recording medium with the use of one of the electrophotographic image forming methods. An electrophotographic image forming apparatus includes, for example, an electrophotographic copying machine, an electrophotographic printer (for example, laser beam printer, LED printer, etc.), facsimileing machine, wordprocessor, etc.

As the cumulative usage of an electrophotographic image forming apparatus, that is, an apparatus employing an electrophotographic image forming method, exceeds a certain length of time, it is necessary to replace the image bearing member of the apparatus, to supply the apparatus with developer, to replace the developer, or to adjust, clean, or replace the other components (charging device, cleaning means container, etc.).

Thus, it is a common practice in the field of an electrophotographic image forming apparatus to employ one of the process cartridge systems, according to which an image bearing member, and one or more of processing means which act on the image bearing member, are integrally disposed in a cartridge removably mountable in the main assembly of an electrophotographic image forming apparatus. Also according to a process cartridge system, it is possible for a user to maintain the apparatus without relying on a service person, improving remarkably the apparatus in operability. Thus, a process cartridge system has come to be widely used in the field of an image forming apparatus.

FIG. 24 shows a typical process cartridge removably mountable in an image forming apparatus of a conventional type.

As will be evident from FIG. 24, a process cartridge P internally holds a developing apparatus 4 as a developing means. More specifically, in the process cartridge P, a development roller 5, in the hollow of which a magnetic roller 6 is disposed, is rotatably attached to a developing means container 3, with the interposition of roller bearings (unshown). As developer is delivered to the development roller 5 from the developing means container 3, it is adhered to the peripheral surface of the development roller 5 by the magnetic force of the magnetic roller 6, forming a developer layer, uneven in thickness, on the peripheral surface of the development roller 5. Then, as the development roller 5 is rotated, the layer of developer on the peripheral surface of the development roller 5 is regulated in thickness, becoming a developer layer of a predetermined thickness. Then, the developer layer with the predetermined thickness is conveyed by the further rotation of the development roller 5 to the location at which the distance between the peripheral surfaces of the photoconductive drum and development roller 5 of the image forming apparatus is smallest. At this location, the toner in the developer layer develops the electrostatic latent image on the peripheral surface of the photoconductive drum into a visible image, that is, an image formed of toner; the toner adheres to the peripheral surface of the photoconductive drum, in the pattern of the electrostatic latent image on the peripheral surface of the photoconductive drum.

There are a pair of sealing members 20 of a contact type, disposed in contact with the peripheral surfaces of the lengthwise end portions of the development roller 5, one for one, to prevent the developer in the developing means container 3 from scattering outward. Also, there are a pair of scrapers 8 (FIG. 12) disposed in contact with the peripheral surfaces of the lengthwise end portions of the development roller 5, one for one. In terms of the rotational direction of the development roller 5, the scrapers 8 are on the downstream side of the contact type sealing members 20, so that should a certain amount of the developer elude the contact type sealing members 20, it will be guided back into the developing means container, being therefore prevented from leaking out of the developing means container 3. In addition, there is a blow-by prevention sheet 9, which is directly below the development roller 5, being pasted to the developing means container 3 and extending in the lengthwise direction of the development roller 5, to seal the gap between the development roller 5 and developing means container 3 to prevent the developer from leaking from between the development roller 5 and developing means container 3 (for example, Japanese Laid-open Patent Applications 2002-236419 and 2001-350344).

In recent years, an image forming apparatus of a conventional type, such as the one described above, which employs an electrophotographic image forming method, has drastically increased in operational speed. This increase in operational speed is liable to disturb the developer layer on the development roller 5.

This phenomenon will be described next with reference to FIGS. 20–22. The contents of the description which will be given below are the results of the experiments carried out by the inventors of the present invention. Referring to FIG. 20, there are a pair of scrapers 8 disposed in contact with the peripheral surfaces of the lengthwise end portions of the development roller 5, one for one, to prevent developer leak. More specifically, as the development roller 5 is rotated, the peripheral surface of each of the lengthwise end portions of the development roller 5 is scraped by the corresponding scraper 8 so that the developer on the peripheral surface is guided inward of the developing means container 3, in terms of the lengthwise direction of the development roller 5, being prevented from adhering to a spacer ring.

Next, referring to FIG. 21, in the case of the above described structural arrangement which employs the scrapers 8 to scrape the developer on the peripheral surfaces of the lengthwise end portions of the development roller 5, inward of the developing meals container 3 in terms of the lengthwise direction of the development roller 5, the developer sometimes builds up in the specific areas, which are between the development blade 7 and development roller 5, on the immediately inward side of each scraper 8. This build-up of the developer did not result in a problem, as long as the peripheral velocity of the development roller 5 was relatively slow.

The above described build-up of the developer, however, became a problem as the peripheral velocity of the development roller 5 increased. That is, referring to FIG. 22, as the peripheral velocity of the development roller 5 increased, the body of the developer having built up in the above described areas grew inward of the developing means container 3 in terms of the lengthwise direction of the development roller 5, disturbing the developer layer on the peripheral surface of the development roller 5. This disturbance of the developer layer on the peripheral surface of the development roller 5 resulted in the formation of a defective image. It was discovered that the formation of this type of defective image was likely to occur in an image forming apparatus in which the peripheral velocity of its development roller was no less than 150 mm/sec, The mechanism of the formation of this type of defective image seems to be as follows. That is, the body of the developer having built up on the immediately inward side of the scraper 8 is subjected to the centrifugal force resulting from the rotation of the development roller 5. As a result, some of the developer particles in the developer build-up become air borne, and then, reattach themselves to the body of the built up developer, making the body of the built up developer grow, in the form of an icicle, inward of the developing means container 3 in terms of the lengthwise direction of the development roller 5. Even if the developer builds up on the peripheral surfaces of the lengthwise end portions of the development roller 5, on the immediately inward side of the scrapers 8, the built up developer can be prevented from invading into the image formation range 5*a*, as long as there is such a force that acts in the direction to move the built up developer outward of the developing means container 3 in terms of the lengthwise direction of the development roller 5.

However, the magnetic roller 6 is disposed in parallel to the development blade 7. Therefore, the force from the magnetic roller 6 does not work in the direction to move the built up developer outward of the developing means container 3; in other words, it fails to retain the developer having built up on the immediately inward side of each scraper 8. Therefore, the body of the built up developer grows into the image formation range 5*a*, causing the formation of a defective image.

Thus, in the case of an image forming apparatus in which the development roller 5 rotates at a high peripheral velocity, the bodies of developer having built up on the peripheral surface of the development roller 5, in the non-image formation ranges 5*b*, grow into the image formation range 5*a*, and adhere to the development blade 7, in the form of an icicle (which hereinafter will be referred to "icicling phenomenon"), as shown in FIGS. 21 and 22, which show the state of the body of the developer having built up on the immediately inward side of the scraper 8 while 3,000, and 10,000 copies, respectively, were produced. In comparison, FIG. 20 shows the initial state of the inward edge, and its adjacencies, of the scraper 8, in terms of the lengthwise direction of the development blade 7.

SUMMARY OF THE INVENTION

The primary object of the present invention is to provide a development blade capable of preventing the developer layer on the development roller in an image forming apparatus from being disturbed, a developing apparatus employing said development blade, and a process cartridge employing said development blade.

Another object of the present invention is to provide a development blade capable of preventing the formation of a defective image, the defects of which are traceable to the disturbance or the development layer on the peripheral surface of the development roller in an image forming apparatus, a developing apparatus employing said development blade, and a process cartridge employing said development blade.

Another object of the present invention is to provide a development blade comprising: an elastic member for regulating the thickness of the developer layer on the peripheral surface of the development roller; and a supporting member, in the form of a piece of metallic plate, which supports said elastic member and has a pair of projections extending, one for one, from the lengthwise end portions of the supporting member toward the development roller, characterized in that not only is the inward edge of each of said projections, in terms of the lengthwise direction of the development blade (roller), on the inward side of the inward edge of the corresponding scraper, but also, as in the non-image formation range, a developing apparatus employing said development blade, and a process cartridge employing said development blade.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

[Embodiment 1]

Hereinafter, the development blade, developing apparatus, process cartridge, and image forming apparatus in the first embodiment or the present invention will be described with reference to the appended drawings.

Figure 1:
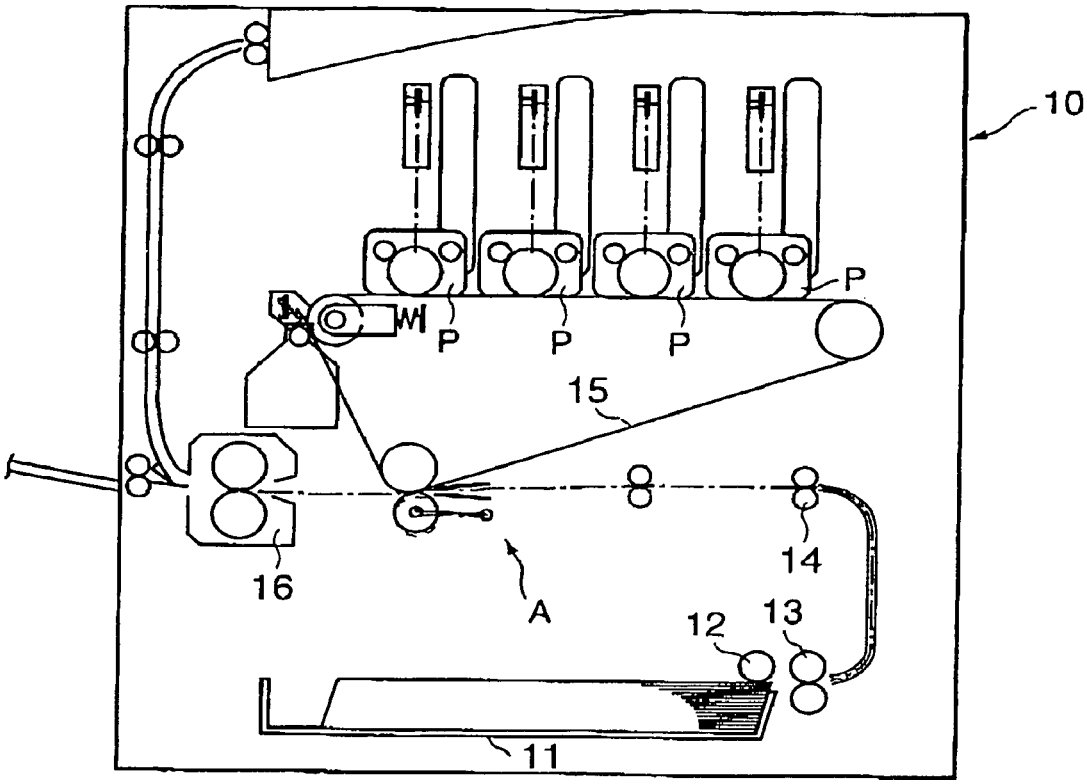
FIG. 1 is a sectional view of the image forming apparatus in the first embodiment of the present invention.

Referring to FIG. 1, which is a sectional view of the image forming apparatus in the first embodiment of the present invention, a plurality of sheets placed in a tray 11 located in the bottom portion of an image forming apparatus 10 are sent by a pickup roller 12 to a pair of conveyance rollers 13, and are sent by the pair of conveyance rollers 13 and a pair of conveyance rollers 14 to an image transferring portion A. In the image transferring portion A, a toner image which has been transferred onto an intermediary transfer belt 15 from the photoconductive drum 1 of the process cartridge P is transferred onto the sheet, from the intermediary transfer belt 15. Then, the sheet is conveyed to a fixing apparatus 16. In the fixing apparatus 16, the toner image which has just been transferred onto the sheet is fixed. Then, the sheet is discharged out of the image forming apparatus 10.

Figure 2:
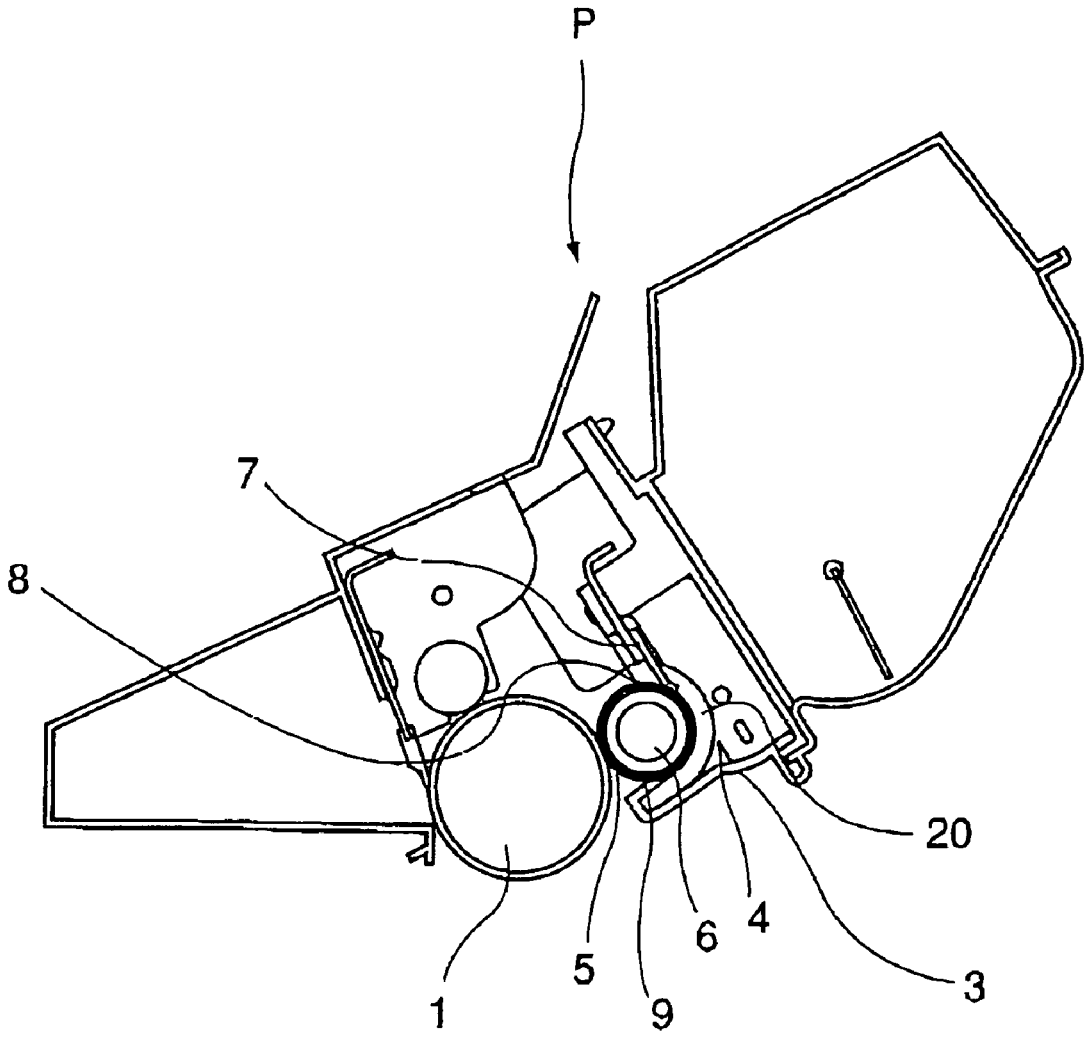
FIG. 2 is a sectional view of a process cartridge.

In the image forming apparatus 10, the process cartridge P is removably mounted. Referring to FIG. 2, which is a sectional view of the process cartridge P, the process cartridge P internally holds the developing apparatus 4 as a developing means. The developing apparatus 4 comprises the development roller 5, in the hollow of which the magnetic roller 6 is disposed. The development roller 5 is rotatably attached to the developing means container 3, with the interposition of a pair of unshown roller bearings. Developer is supplied from the developing means container 3 to the development roller 5, and is adhered to the peripheral surface of the development roller 5 by the magnetic force of the magnetic roller 6, forming a developer layer on the peripheral surface of the development roller 5 as the development roller 5 is rotated. As the development roller 5 is further rotated, the developer layer is regulated in thickness by the development blade 7. Then, the developer layer is conveyed by the further rotation of the development roller 5 to the location at which the distance between the developer layer and the latent image on the peripheral surface of the photoconductive drum 1 is closest. At this location, the toner particles in the development layer adhere to the peripheral surface of the photoconductive drum 1 in a manner to reflect the pattern of the latent image, creating a visible image formed of toner.

There are a pair of contact type sealing members 20 disposed in contact with the peripheral surfaces of the lengthwise end portions, one for one, of the development roller 5 to prevent the developer in the developing means container 3 from leaking out of the container 3. There are also a pair of scrapers 8 disposed in contact with the peripheral surfaces of the lengthwise end portions, one for one, of the development roller 5. In terms of the rotational direction of the development roller 5, the pair of scrapers 8 are on the downstream side of the pair of contact type sealing members 20, to return the developer having eluded the contact type sealing members 20, to the development range to prevent the developer from leaking out of the developing means container 3. In addition, there is the blow-out prevention sheet 9 directly below the development roller 5, being pasted to the developing means container 3 and extending in the lengthwise direction of the development roller 5 to seal the gap between the development roller 5 and developing means container 3 to prevent the developer from leaking from between the development roller 5 and developing means container 3.

(Structure of Development Blade)

Figure 7:
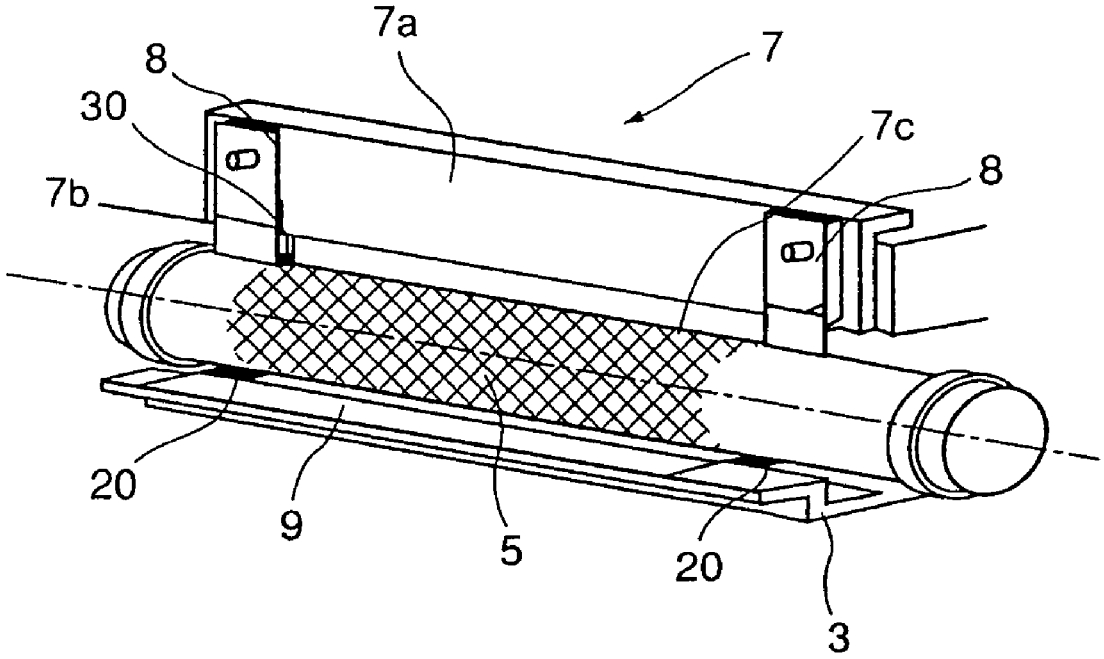
FIG. 7 is a perspective view of a developing apparatus provided with a pair of scrapers.
Figure 8:
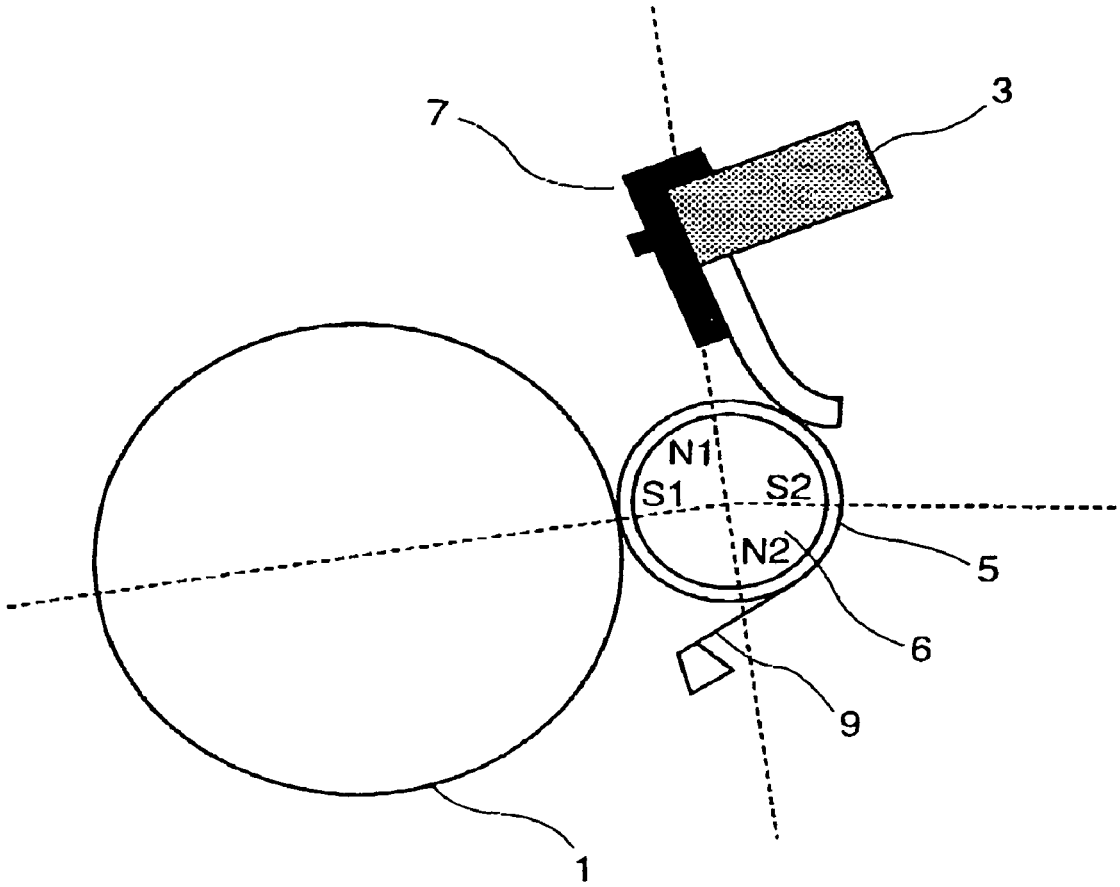
FIG. 8 is a schematic sectional view of a development blade, and its adjacencies, for showing the structure of the blade.

Referring to FIG. 8, the development blade 7 comprises a metallic plate 7*a* with a thickness of 1–2 mm, and an elastic member 7*c* fixed to the metallic plate 7*a* with the use of a hot-melt glue, two-side adhesive tape, or the like. The development blade 7 is disposed so that the elastic member 7*c* contacts the peripheral surface of the development roller 5. Thus, as the portion of the peripheral surface of the photoconductive drum 1, across which the developer layer is borne, reaches the elastic member 7*c*, not only is the developer layer regulated in thickness (amount), but also is given triboelectrical charge. In this embodiment, in order to make the development blade pressure uniform in terms of the lengthwise direction of the development roller 5, the distance between the edge of the metallic plate 7*a* (FIG. 7) and the peripheral surface of the development roller 5, in the image formation range 5*a*, is set to 2.5 mm.

(Structure of Magnetic Roller)

Figure 9:
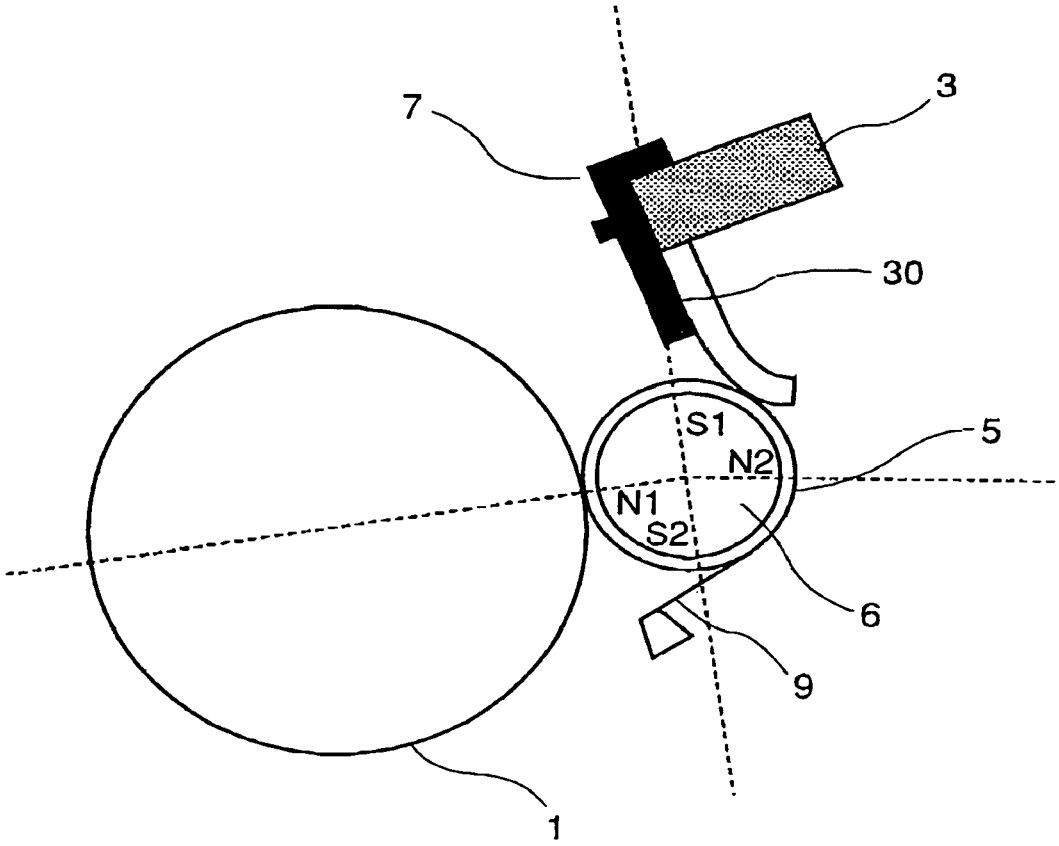
FIG. 9 is also a schematic sectional view of a development blade, and its adjacencies, for showing the structure of the blade.

Also referring to FIG. 8, the magnetic roller 6 solidly disposed in the hollow of the development roller 5 has at least four magnetic poles, that is, two south poles S1 and S2, and two north poles N1 and N2. The developer is held to the peripheral surface of the development roller 5 by the magnetic roller 6. The magnetic roller 6 is disposed so that its north pole N1 is positioned on the downstream side; in terms of the rotational direction of the development roller 5; of the contact area between the development blade 7 and development roller 5. If the north pole N1 is in the adjacencies of the contact area, the developer layer is liable to crest in the adjacencies of the contact area, disturbing thereby the developer layer. The disturbance of the developer layer results in improper development. On the other hand, if the magnetic roller 6 is disposed so that the north pole N1 is positioned tow far from the contact area, the magnetic force of the magnetic roller 6 is not effective to circulate the developer in the developing means container 3, being likely to allow the developer to accumulate in the adjacencies of the development roller 5. If the developer accumulates in the adjacencies of the development roller 5, it is repeatedly rubbed by the development roller 5, which is likely to hasten the deterioration of the developer. Incidentally, the magnetic roller 6 may be disposed so that the N poles and S poles are reversed in position, as shown in FIG. 9. Such a placement of the magnetic roller 6 brings forth the same effects as those described above.

(Method for Sealing Developing Means Container)

Figure 6:
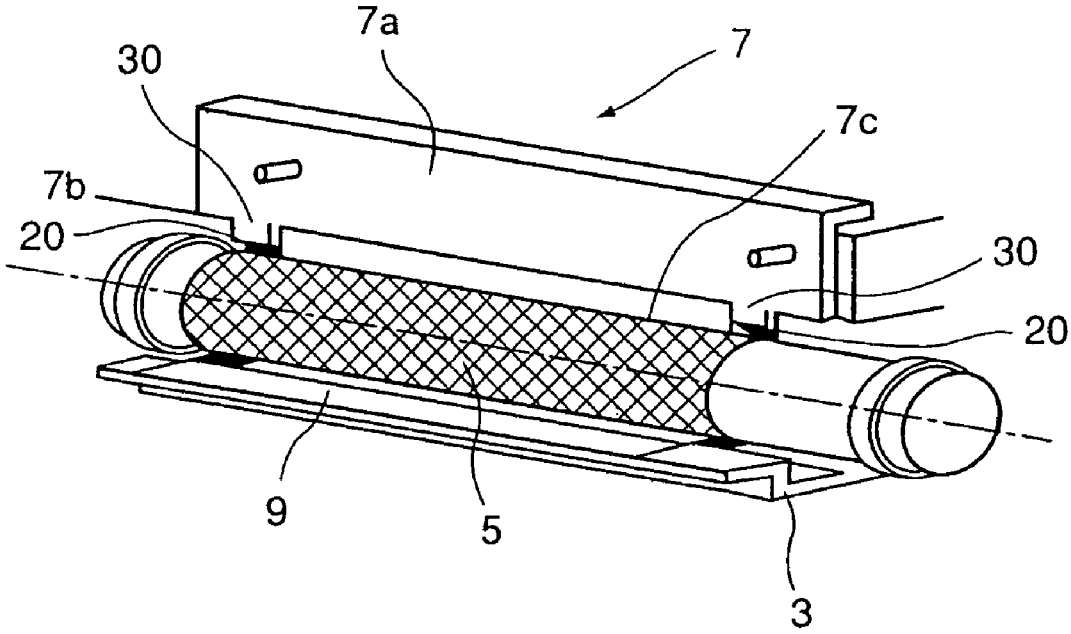
FIG. 6 is a perspective view of the developing apparatus.
Figure 10:
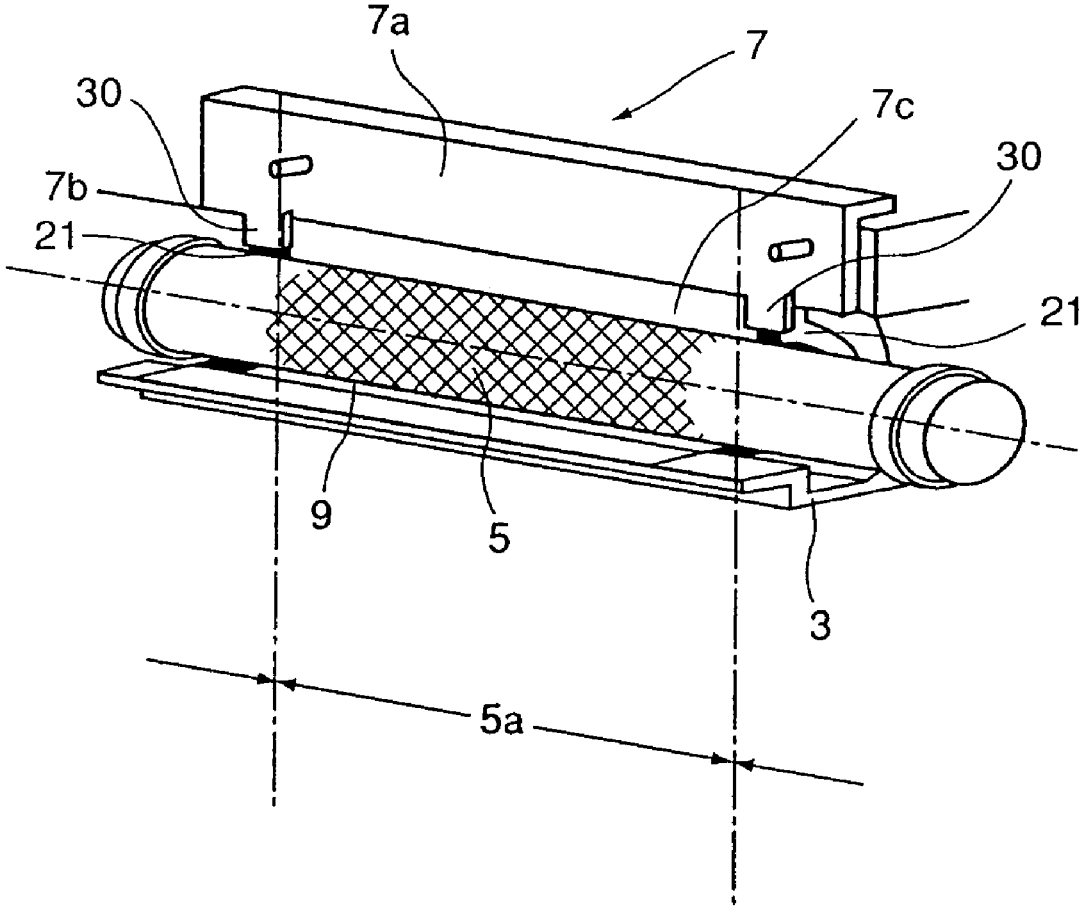
FIG. 10 is a perspective view of a developing apparatus provided with a pair of scrapers.
Figure 11:
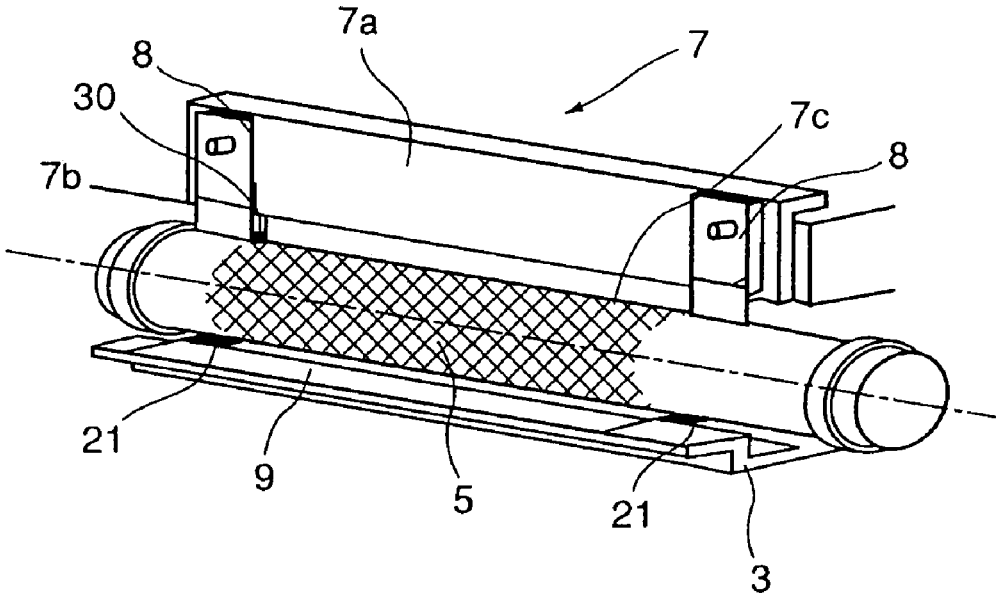
FIG. 11 is a schematic perspective view of a developing apparatus.
Figure 12:
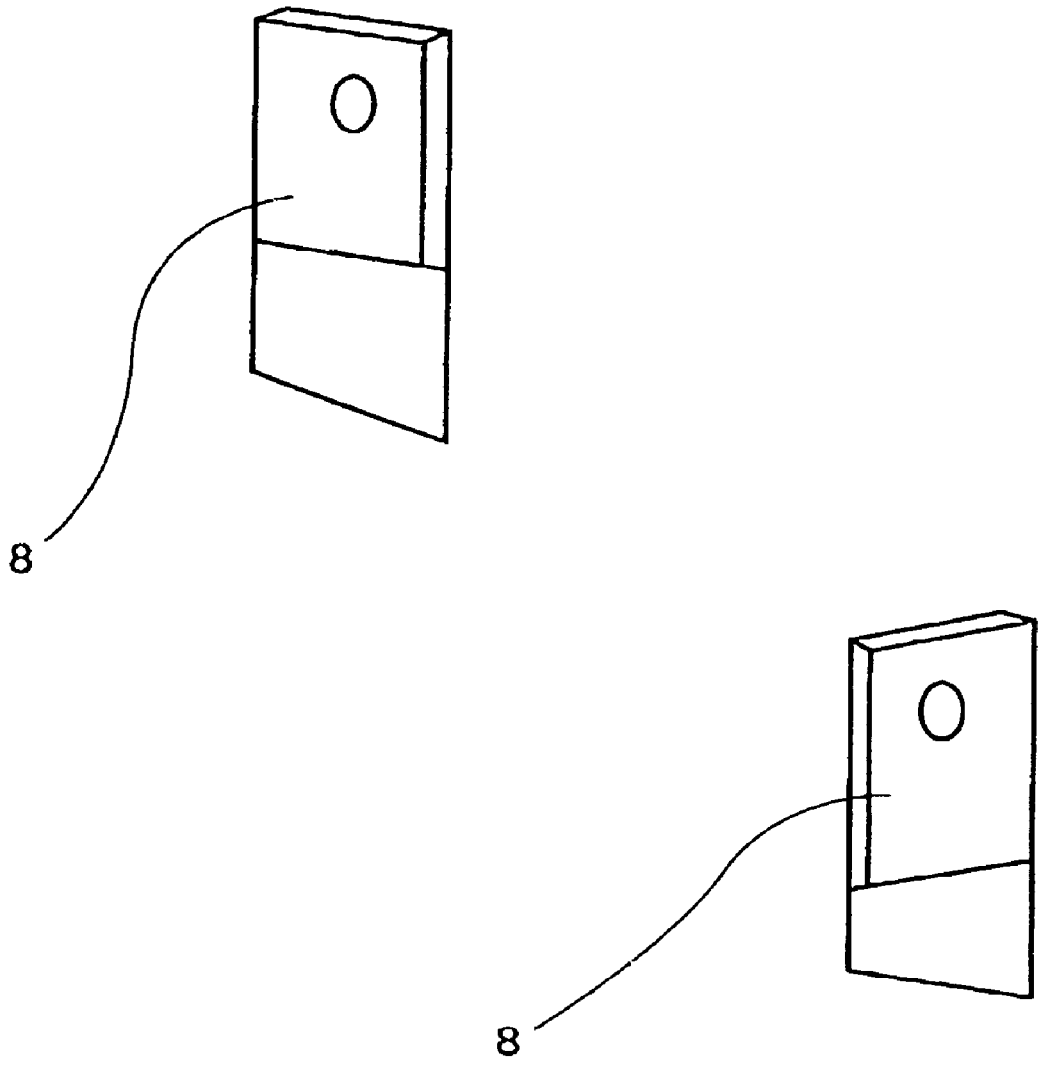
FIG. 12 is a perspective view of a pair of scrapers.

Referring to FIGS. 6 and 7, as one of the methods for preventing developer from leaking out of the developing means container 3, there has been known the method in which the pair of contact type sealing members 20 formed of felt or the like are placed in contact with the development roller 5, in the non-image formation ranges 5*b*. Also known as the method for preventing developer from the developing means container 3 is the method in which a pair of magnetic sealing members 21 are placed close to the peripheral surface of the development roller 5 as shown in FIGS. 10 and 11, that is, with no contact between the magnetic sealing members 21 and the peripheral surface of the development roller 5, so that developer is held by the magnetic forces of the magnetic sealing members 21.

Referring to FIGS. 6 and 7, the development blade 7 is in contact with the development roller 5, and the edge 7*b* of the metallic plate 7*a* is close to the peripheral surface of the development roller 5. The metallic plate 7*a* is provided with a pair of rectangular projections 30, which extend toward the development roller 5 from the edge 7*b*. Each projection 30 is outside the image formation range 5*a*.

Figure 4:
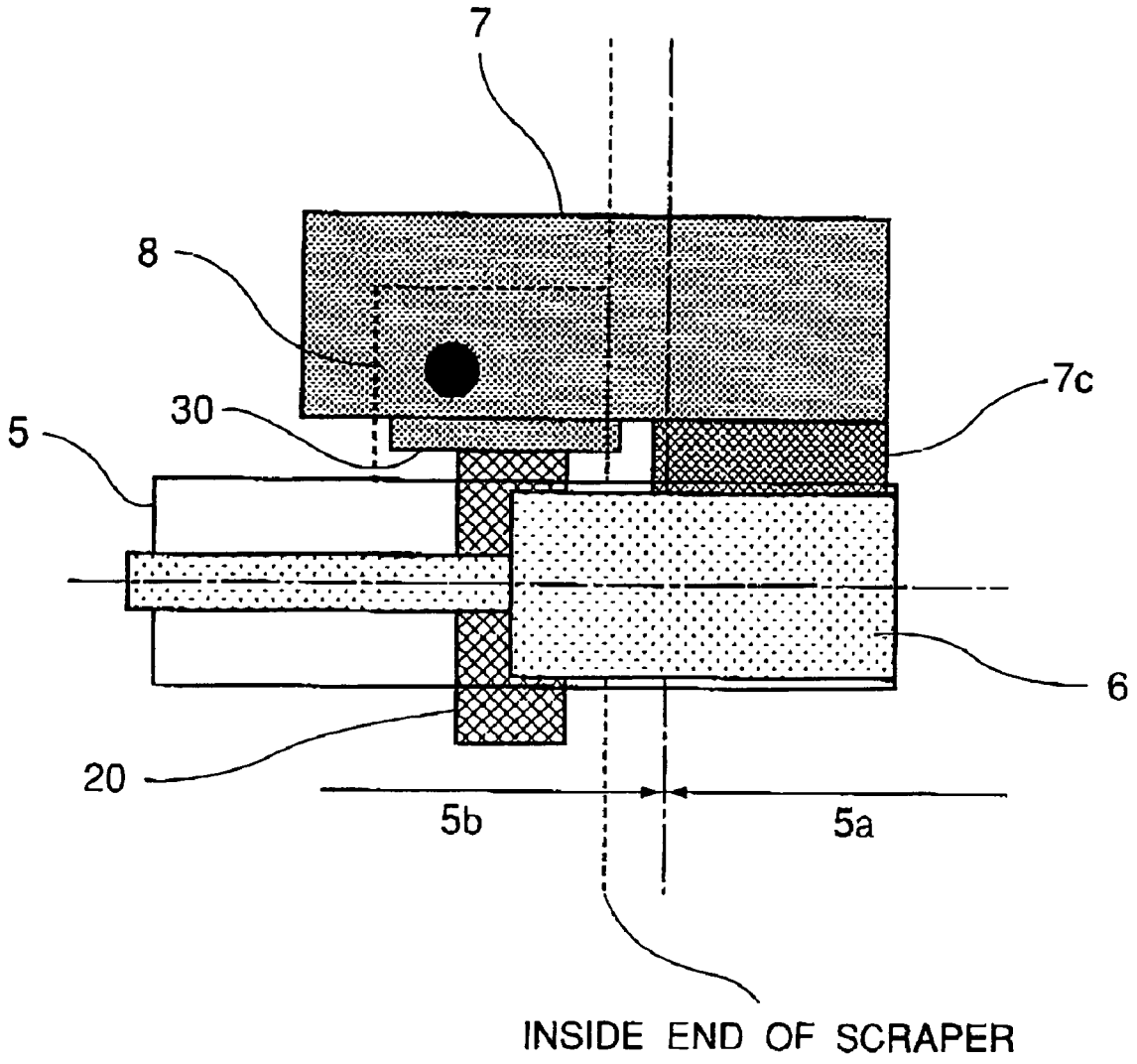
FIG. 4 is a front view of one of the end portions of the development apparatus, for showing the initial state thereof.

FIG. 4 is an enlarged front view of one of the rectangular projections 30 of the development blade 7, and its adjacencies. To describe the positioning of the rectangular projection 30 with reference to FIG. 4, in the image formation range 5*a*, the elastic member 7*c* of the development blade 7 is in contact with the development roller 5. The projection 30 is on the outward side of the elastic member 7*c*, overlapping with the contact type sealing member 20 in terms of the rotational direction of the development roller 5. Further, the projection 30 is positioned so that its inward edge is on the inward side of the inward edge of the scraper 8, and also that its inward edge is in the non-image formation range 5*b*.

In this embodiment, the distance between the metallic supporting plate 7*a* of the development blade 7 and development roller 5, within the image formation range 5*a* is 2.5 mm as described before. The distance between the rectangular projection 30 and the development roller 5 is 1.5 mm. Further, the position of the projection 30 is such that the inward edge of the projection 30 is 0.1 mm inward of the inward edge of the scraper 8.

Figure 3:
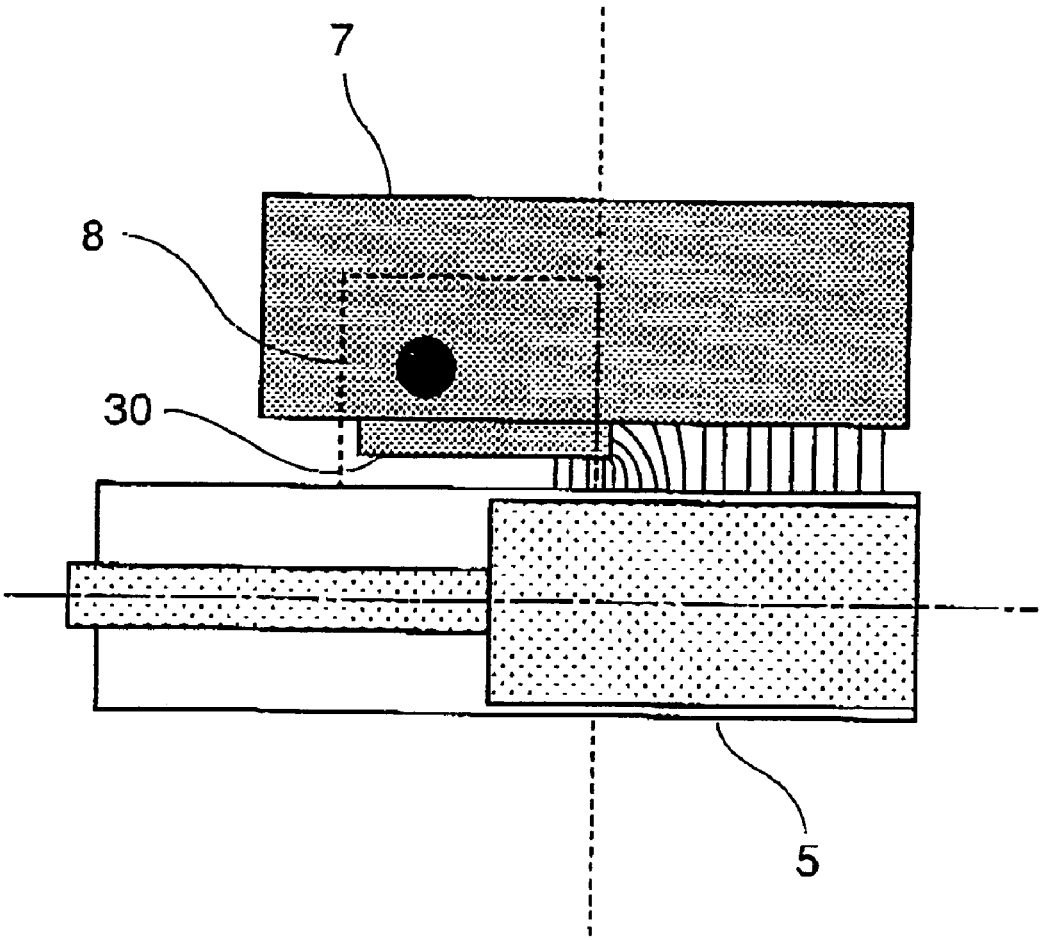
FIG. 3 is a front view of one of the end portions of the developing apparatus, for showing the magnetic lines of force.

Referring to FIG. 3 which is a drawing for showing the relationship among the magnetic roller 6, projection 30, and magnetic lines of force, when the metallic plate 7*b* is provided with the projection 30, a certain part of the magnetic force from the magnetic roller 6 acts in the lengthwise direction of the development blade 7 (development roller 5) as indicated by the magnetic lines of force between the metallic plate 7*b* and development roller 5 in FIG. 3. In this case, the amount of the magnetic force acting in the lengthwise direction of the development blade 7, at the inward edge of the scraper 8 in FIG. 3, was 18 G. In comparison, when the metallic plate 7*b* is not provided with the projections 30 (FIG. 23), virtually no part of the magnetic force from the magnetic plate 6 acts in the lengthwise direction of the development blade 7 as indicated by the magnetic lines of force between the metallic plate 7*b* and development roller 5 in FIG. 23. In this case, the magnetic force acting in the lengthwise direction of the development roller 5, at the inward edge of the scraper 8, was in the range of 2–4 G.

In this embodiment, if the scraper 8 is provided in order to prevent developer from building up in the non-image formation range 5*b*, developer builds up on the immediately inward side of the inward edge of the scraper 8. In comparison, providing the development blade 7 with the pair of projections 30 positioned as described above subjects the developer having built up on the immediately inward side of the scraper 8, to the substantial amount of the magnetic force acting in the lengthwise direction of the development roller 5. Also in this embodiment, each projection 30 is positioned so that the inward edge of the projection 30 will be on the inward side of the inward edge of the corresponding scraper 8. Therefore, it is assured that the developer having built up on the peripheral surfaces of the end portions of the development roller 5 is trapped, on the inward side of the lengthwise ends of the development blade 7.

In other words, this embodiment makes it possible to simply and inexpensively prevent the developer build-up from growing in width inward of the developing means container 3, in terms of the lengthwise direction of the development blade 7 (development roller 5), preventing thereby the formation of a defective image, the defects of which are traceable to the developer build-up, within the image formation range 5*a*.

Figure 5:
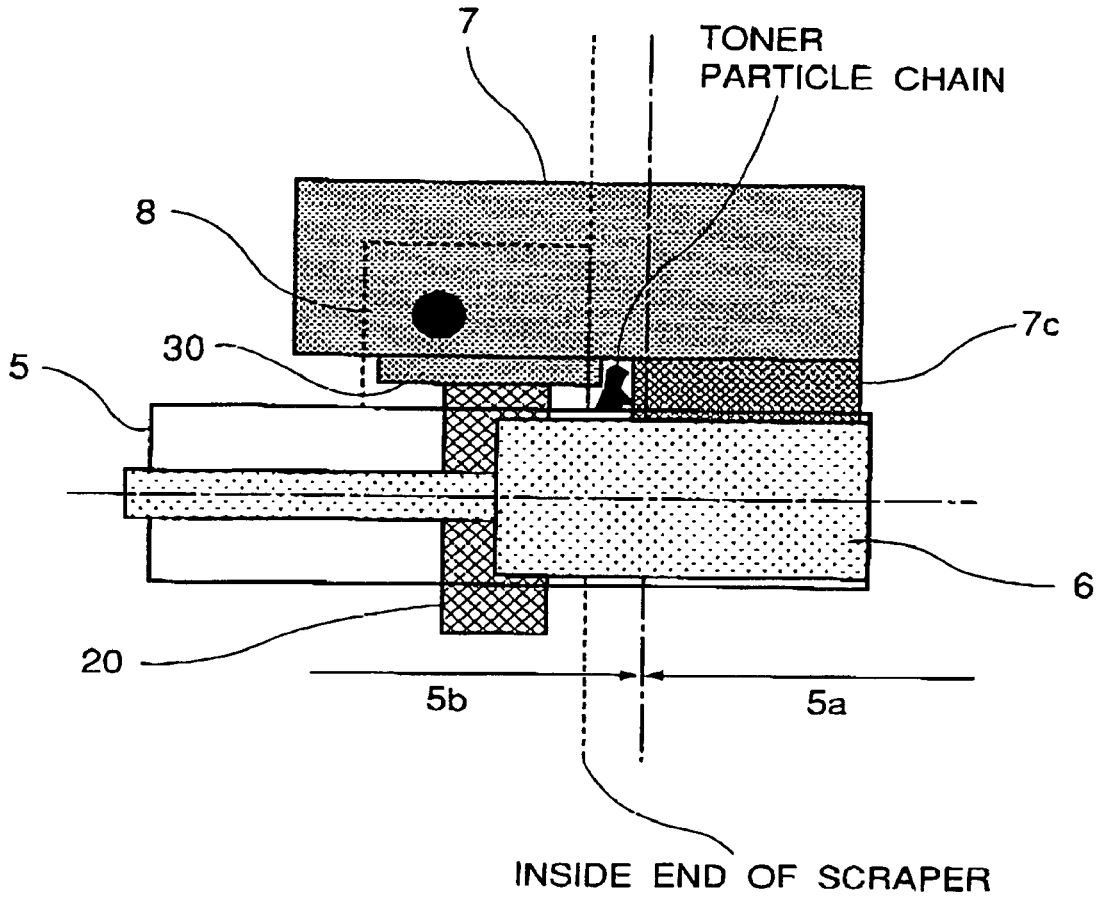
FIG. 5 is a front view of one of the end portions of the development apparatus, for showing the state thereof after the production of 10,000 copies.

Incidentally, this embodiment makes it possible to prevent the state of the peripheral surface of the portion of the development roller 5, on the immediately inward side of the scraper 8, from changing from the state (initial state) shown in FIG. 4 to the state (after production of 10,000 copies) shown in FIG. 5, that is, to prevent the developer build-up from growing into the image formation range 5*a*, preventing thereby the developer layer on the development roller 5 from being disturbed by the developer having built up (crested).

(Experiment)

Figure 13:
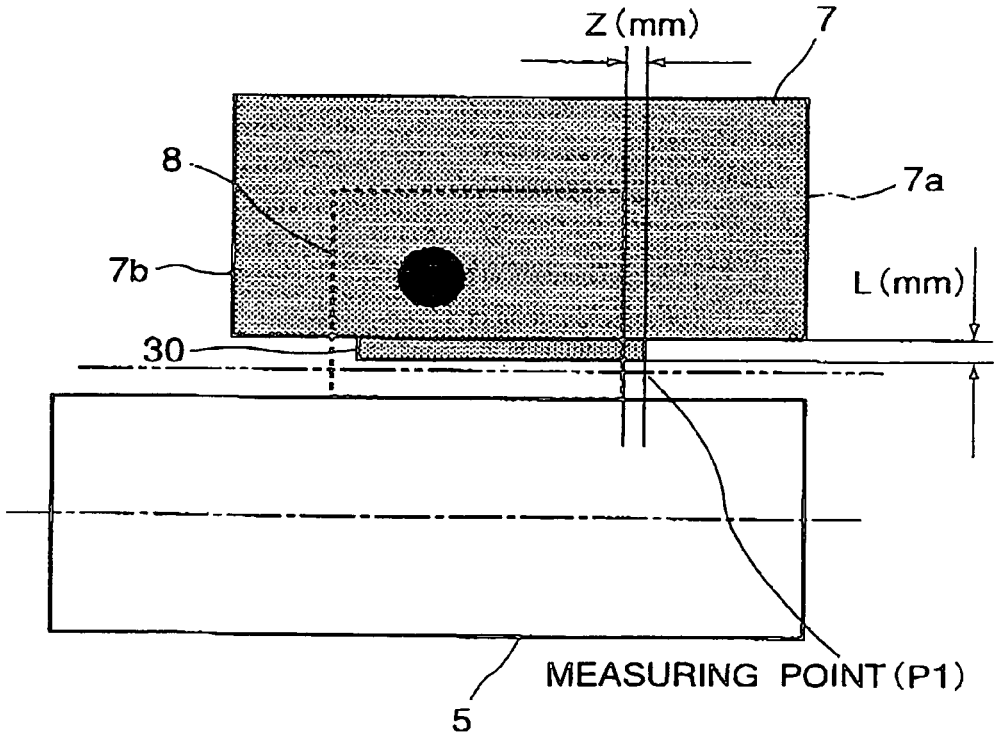
FIG. 13 is a combination of tables and the front view of one of the lengthwise end portion of the developing apparatus, for showing the relationship between the position of the projection of the metallic supporting member, and the effectiveness of the projection.

Referring to FIG. 13(*c*), a plurality of development blades 7 were prepared, which were different in the distance Z (mm) between the inward edge of the scraper 8 and the inward edge of the rectangular projection 30, and the distance L (mm) by which the rectangular projection 30 extends toward the development roller 5 from the edge 7*b* of the metallic plate 7*a* of the development blade 7, that is, the distance between the edge of the projection 30, on the development roller 5 side, and the edge of the metallic plate 7*a*, on the development roller 5 side, as shown in Tables (a) and (b), and 10,000 copies were made using each development blade 7 to evaluate it in terms of image defectiveness after the production or the 10,000th copy. Referring to Tables (a) and (b) in FIG. 13, if the value of Z (mm) is −0.1 mm, it means that, in terms of the lengthwise direction of the development blade 7 (development roller 5), the inward edge of the projection 30 is 0.1 mm outward of the inward edge of the scraper 8. Evaluation symbols x and Δ in Table (a) in FIG. 13 means that the "icicling phenomenon" occurred, and resulted in the formation of a defective image, x indicating that the defects were severe. Evaluation symbols ○ and ◎ mean that the "icicling phenomenon" did not occur, and therefore, a preferable image was obtained, ◎ indicating that an extremely good image was obtained.

Referring to Table (a) in FIG. 13, when the distance L by which the projection 30 extended toward the development roller 5 was in the range of 0.5 mm–1.5 mm, and at the same time, the distance Z between the inward edge of the scraper 8 and the inward edge of the projection 30 was in the range of 0.1 mm–0.5 mm, preferable images could be obtained. Referring to Table (b) in FIG. 13, when the values of the distances Land Z were in the respective ranges, in which the quality of the obtained images were indicated by the evaluation symbols ○ and ◎, the amount of the magnetic force acting in the lengthwise direction of the development blade 7 (development roller 5), measured at a point P1 in FIG. 13(*c*) was no less than 15 G.

It is evident from the results of the above described experiment that as long as each projection 30 is positioned so that, in terms of the lengthwise direction of the development roller 5, not only will the inward edge of the projection 30 be on the inward side of the inward edge of the corresponding scraper 8, but also, the distance L by which the projection 30 extends toward the development roller 5 from the edge 7*b* of the metallic plate 7*a* is no less than 0.5 mm, the above described effects can be obtained.

In another experiment, instead of the pair of contact type sealing members 20, a pair of magnetic sealing members 21 were disposed as shown in FIG. 10 or 11, with no contact between the magnetic sealing members 21 and the development roller 5, in order to retain developer by the magnetic force of the magnetic sealing members 21. The effects obtained in this experiment were confirmed to be the same as those obtained in the preceding experiment.

The image forming apparatus 10 in this embodiment is an image forming apparatus in which the process cartridge P having the developing apparatus 4 is removably mountable. However, this embodiment is not intended to limit the scope of the present invention. On the contrary, the present invention is also applicable to an image forming apparatus which does not employ the process cartridge P, and in which the developing apparatus 4 is unremovably disposed.

[Embodiment 2]

Next, the development blade, developing apparatus, process cartridge, and image forming apparatus in the second embodiment of the present invention will be described with reference to the appended drawings. The components, members, etc., in this embodiment, which are the duplicates of those in the first embodiment, will be given the same referential symbols, and will not be described.

This embodiment of the present invention is different from the first embodiment in that the projection 31 of the development blade 7 in this embodiment is different in shape from the projection 30 of the development blade 7 in the first embodiment. Thus, the shape and position of the projection 31 of the development blade 7 in this embodiment will be described with reference to FIG. 14.

Figure 14:
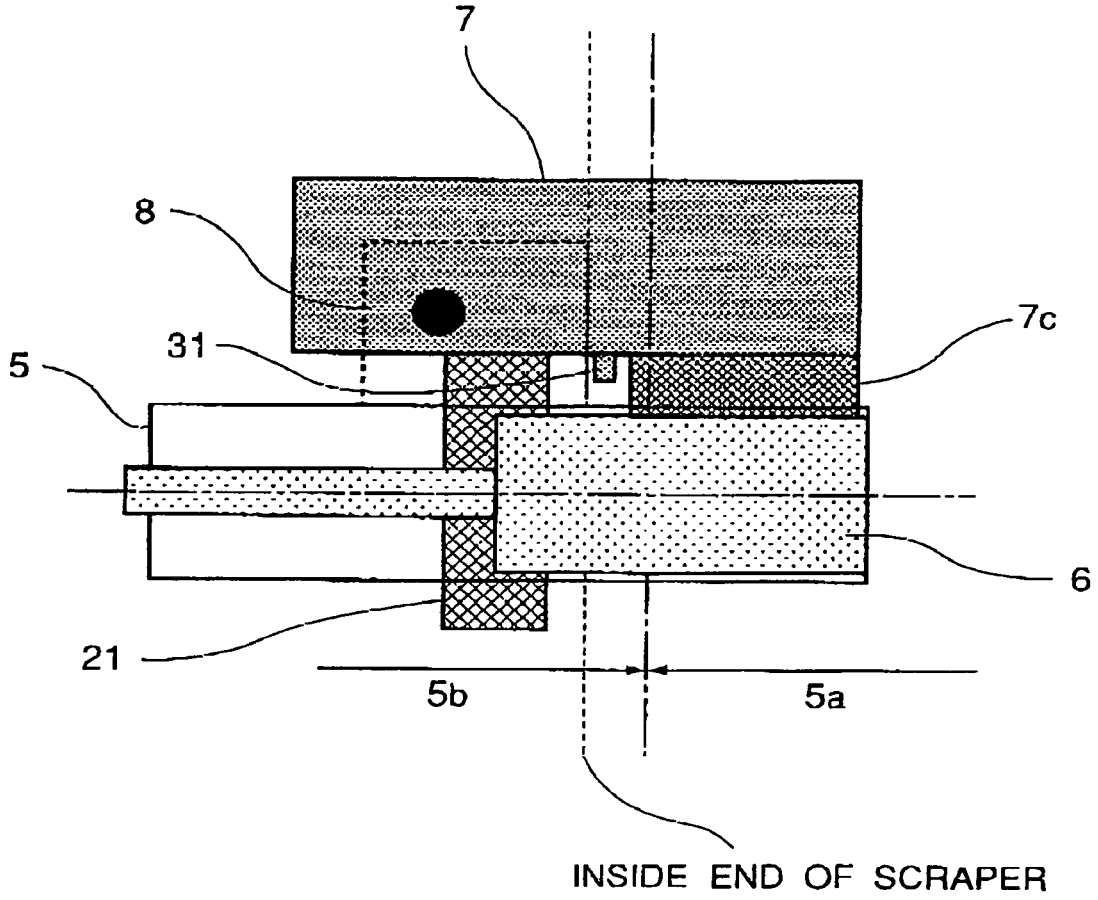
FIG. 14 is a front view of one of the lengthwise end portions of the developing apparatus in the second embodiment of the present invention.

As will be evident from FIG. 14, each of the pair of projections 31 of the development blade 7 is within the non-image formation range 5*b*, and on the inward side of the inward edge of the corresponding scraper 8, in terms of the lengthwise direction of the development blade 7. More concretely, within the image formation range 5*a*, the distance between the metallic supporting blade 7*a* of the development blade 7 and development roller 5, is 2.5 mm, and the distance between the projection 31 and development roller 5 is 1.5 mm. Further, the outward edge of the projection 31 in terms of the lengthwise direction of the development blade 7, is 0.1 mm inward of the inward edge of the scraper 8 in terms of the lengthwise direction thereof. In addition, the inward edge of the projection 31 is 0.2 mm outward of the outward edge of the elastic member 7*c* of the development blade 7, in terms of the lengthwise direction of the development blade 7.

Figure 15:
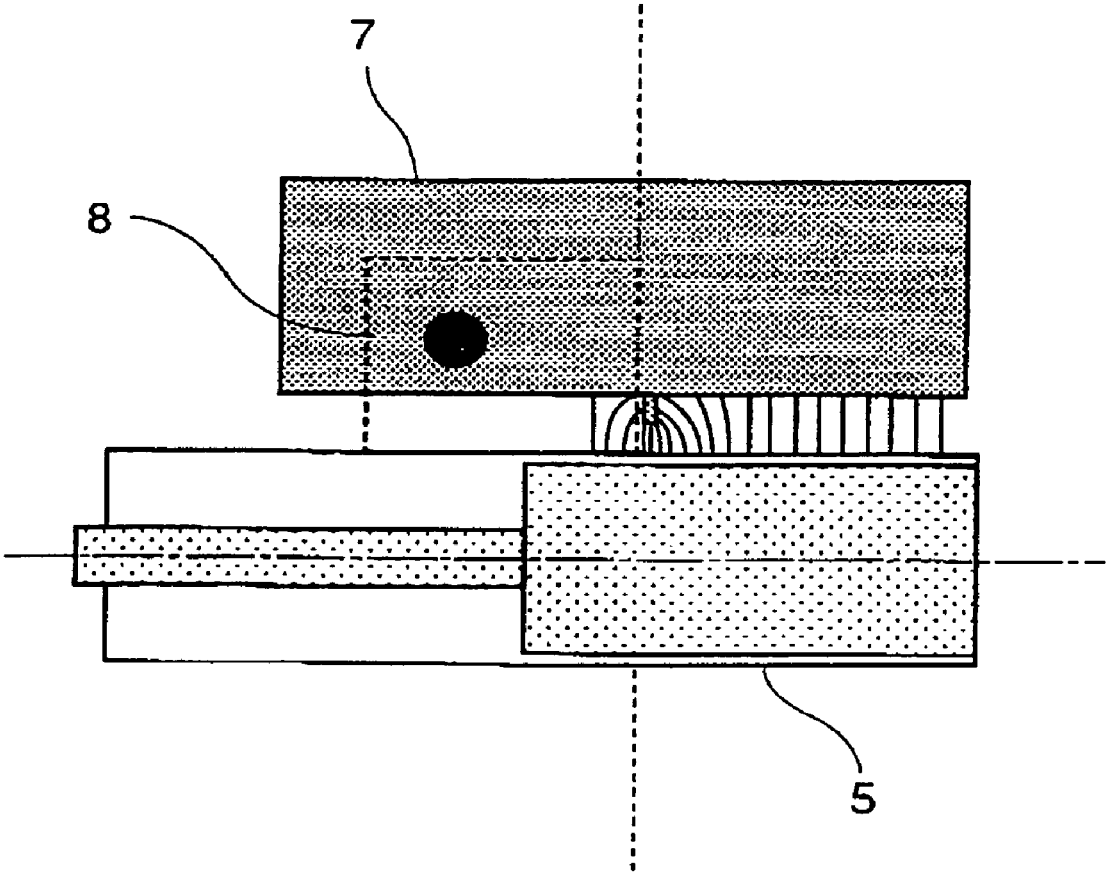
FIG. 15 is a front view of one of the lengthwise end portions of the developing apparatus, for showing the magnetic lines of force.
Figure 23:
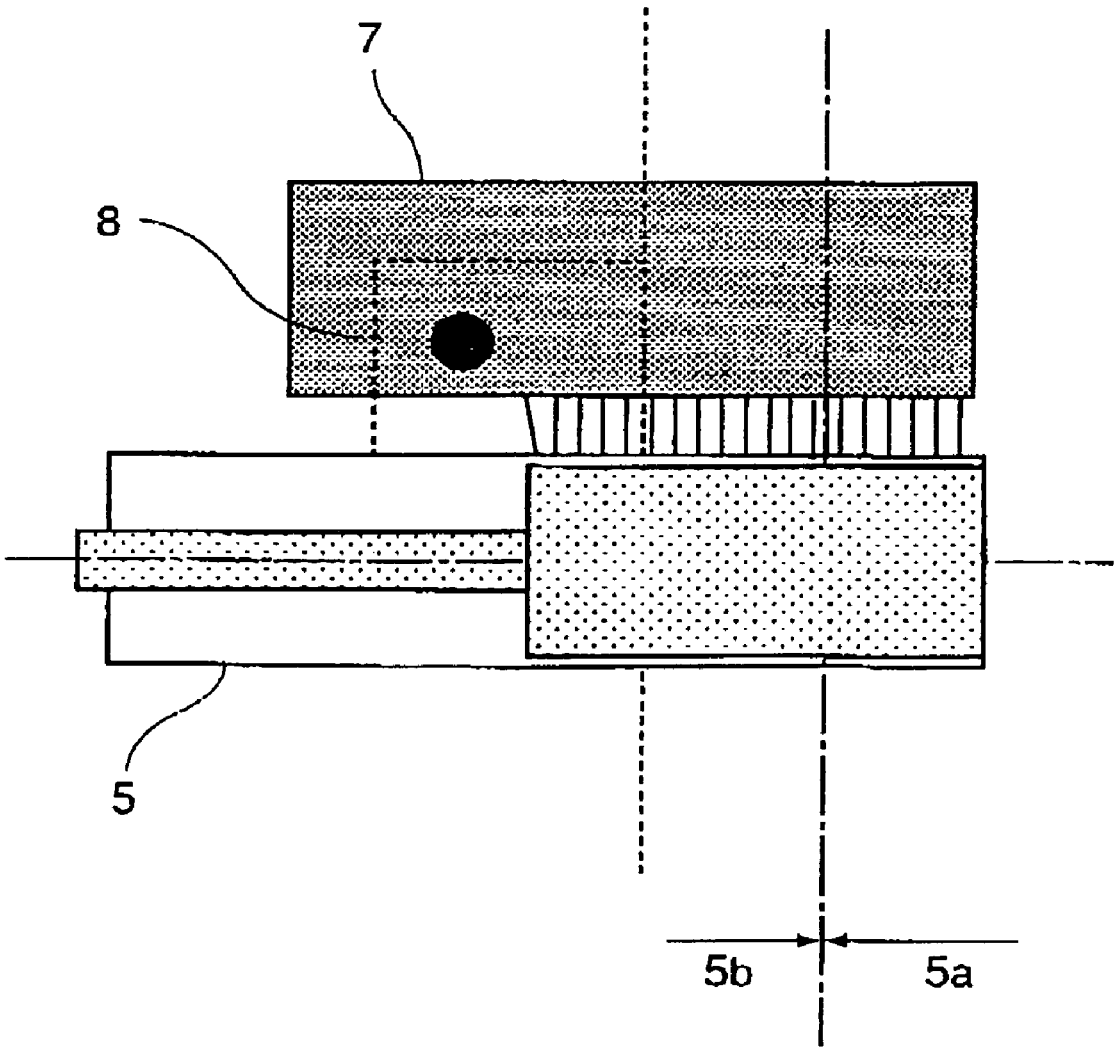
FIG. 23 is a front view of one of the lengthwise end portions of a typical developing apparatus in accordance with the conventional arts, for showing the magnetic lines of force.
Figure 24:
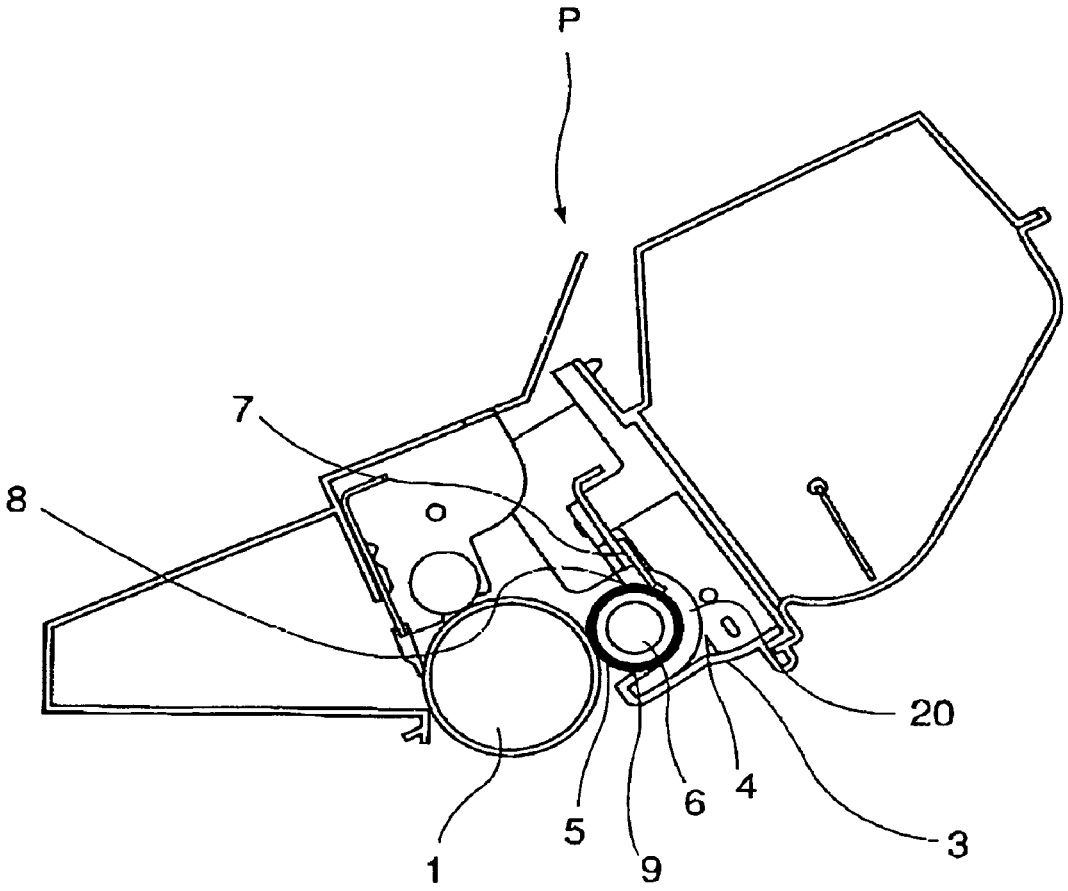
FIG. 24 is a sectional view of a typical process cartridge in accordance with the conventional arts.

Referring to FIG. 15, which shows the magnetic roller 6 and the magnetic lines of force in the adjacencies of the projection 31, wherein the development blade 7 is provided with the pair of projections 31, the magnetic force from the magnetic roller 6 acts in the lengthwise direction of the development blade 7 (development roller 5), in the adjacencies of each projection 31; it works differently compared to where the development blade 7 is not provided with the pair of projections 31 (FIG. 23). The amount of the magnetic force acting in the lengthwise direction of the development blade 7 at the inward edge of the scraper 8 in FIG. 15 was 18 G. In comparison, the magnetic force acting in the lengthwise direction at the inward edge of the scraper 8 shown in FIG. 23 was roughly 2–4 G.

Also in this embodiment, the provision of the pair of scrapers 8 to prevent developer from building up in the non-image formation ranges 5*b*, causes developer to build up on the immediately inward side of the inward edge of each scraper 8, and eventually attach to the development blade 7 in the form of an icicle. However, providing the development blade 7 with the pair of projections 31 as described above causes the developer having built up on the immediately inward side of each scraper 8, to be subjected to the magnetic force which acts in the lengthwise direction of the development blade 7. In addition, in this embodiment, each projection 31 is shaped and positioned so that the inward edge of the projection will be on the inward side of the inward edge of the corresponding scraper 8. Therefore, it is assured that the developer having built up will be trapped.

In other words, this embodiment also can inexpensively and easily prevent the developer build-up from growing inward of the developing means container 3 in terms of the lengthwise direction of the development blade 7 (development roller 5), preventing thereby the formation of a defective image, the defects of which are traceable to the occurrence of the icicling phenomenon in the image formation range 5*a*.

(Experiment)

Referring to FIG. 15, a plurality of development blades 7 were prepared, which were the same, being 0.1 mm, in the dimension of the projection 31 in terms of the lengthwise direction of the development blade 7, and were different in the distance L (mm) by which the projection 31 extended toward the development roller 5 from the edge 7*b* of the metallic plate 7*a* of the development blade 7. Then, 10,000 copies were made using each of these development blades 7 to evaluate them in terms of image defect. Referring FIG. 16(*b*), the distance L (mm) is the distance between the edge 7*b* of the metallic plate 7*a* of the development blade 7, on the development roller 5 side, and the edge of the projection 31, on the development roller 5 side. Evaluation symbols x and Δ in Table (a) in FIG. 16 mean that the "icicling phenomenon" occurred, and resulted in the formation of a defective image, indicating that the defects were severe. Evaluation symbols ○ and ◎ mean that the "icicling phenomenon" did not occur, and therefore, a preferable image was obtained, ◎ indicating that an extremely good image was obtained.

Figure 16:
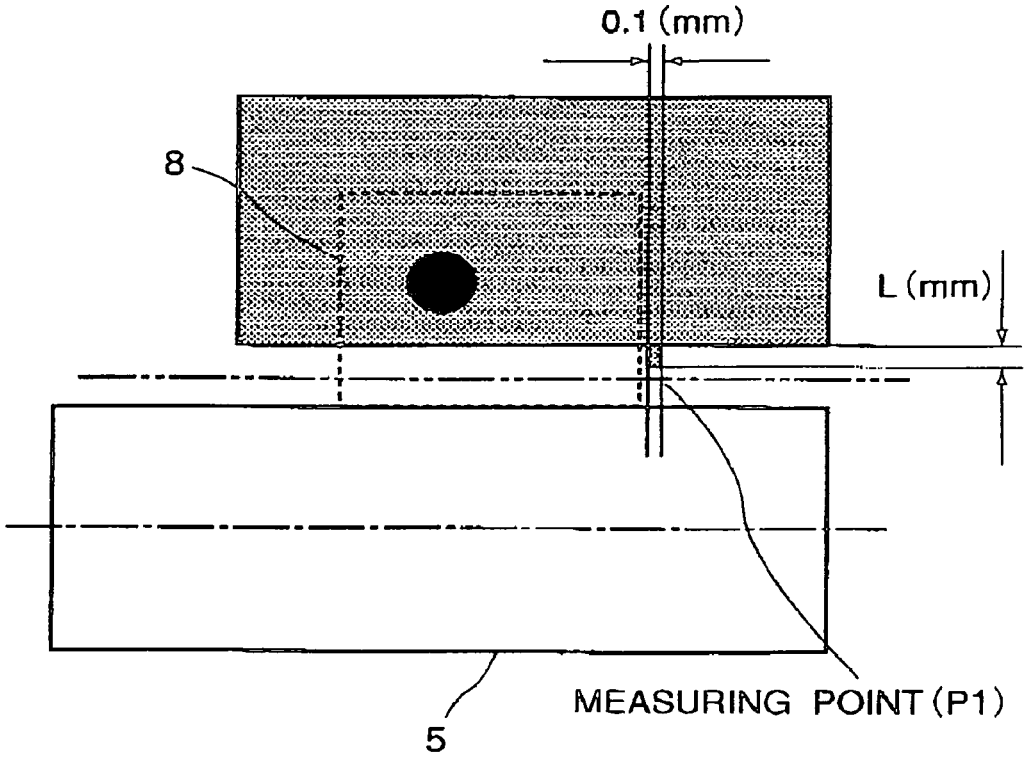
FIG. 16 is a combination of a table, and the front view of one of the lengthwise end portions of the developing apparatus, for showing the relationship between the position of the projection of the metallic supporting member, and the effectiveness of the projection.

Referring to Table (a) in FIG. 16, when the distance L by which the projection 31 extended toward the development roller 5 was in the range of 0.5 mm–1.5 mm, preferable images could be obtained. In the case of the development blades 7 which earned the evaluation symbol of ○ or ◎, the amount of the magnetic force acting in the lengthwise direction of the development blade 7, measured at a point P1 in FIG. 16(*b*) was no less than 15 G.

The durability tests carried out using the development blades 7 in this embodiment also proved that as long as the distance L by which each projection 31 extends toward the development roller 5 is no less than 0.5 mm, the "icicling phenomenon" do not occur within the image formation range, and therefore, the formation of a defective image, the defects of which are traceable to the circular cresting of developer, do not occur.

[Embodiment 3]

Next, the development blade, developing apparatus, process cartridge, and image forming apparatus in the third embodiment of the present invention will be described with reference to the appended drawings. The components, members, etc., in this embodiment, which are the duplicates of those in the first embodiment, will be given the same referential symbols, and will not be described.

This embodiment of the present invention is different from the first embodiment only in that the projection 32 of the development blade 7 in this embodiment is triangular, being pointed on the development roller 5 side, whereas the projection 30 of the development blade 7 in the first embodiment is rectangular. Thus, only the shape and position of the projection 32 of the development blade 7 in this embodiment will be described with reference to FIG. 17.

Figure 17:
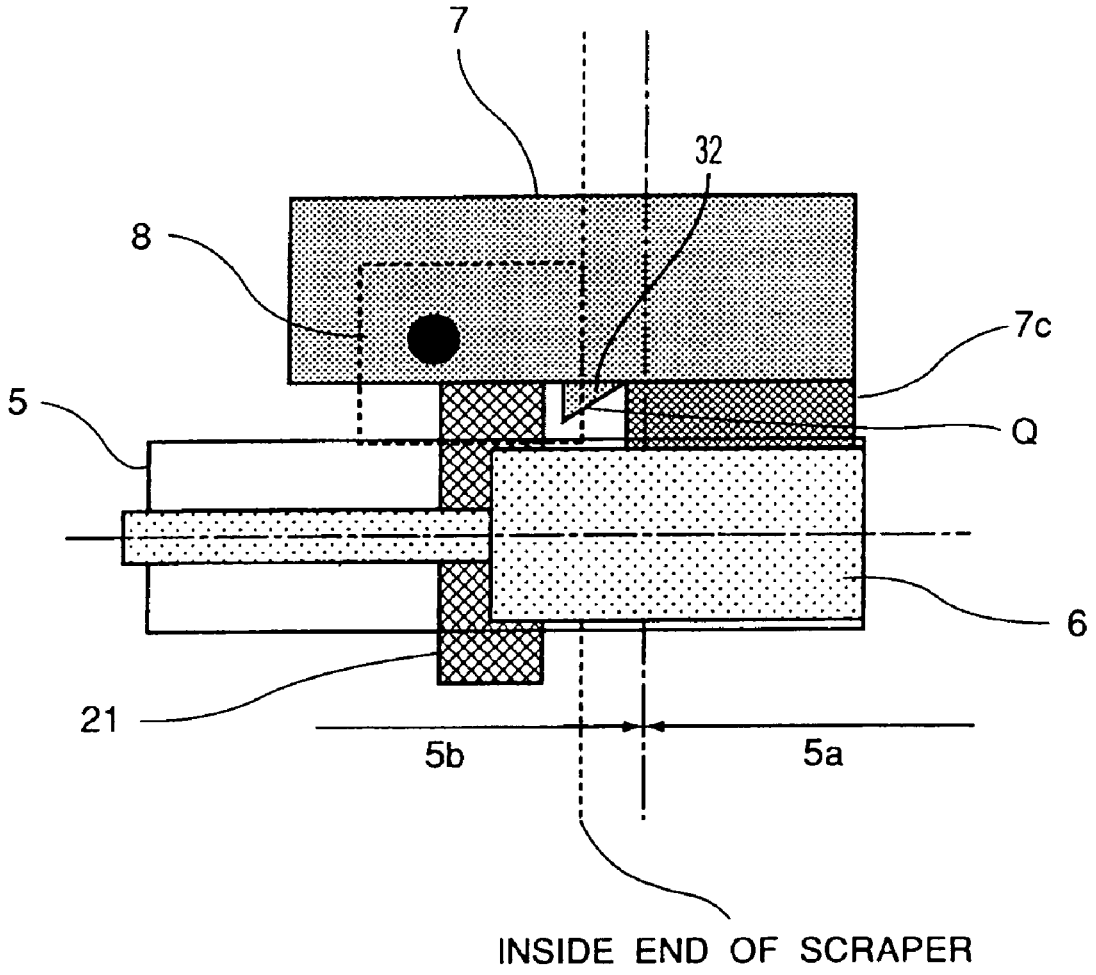
FIG. 17 is a front view of one of the lengthwise end portions of the developing apparatus in the third embodiment of the present invention.

As will be evident from FIG. 17, the base portion of each of the pair of triangular projections 32 is astride the inward edge of the corresponding scraper 8 in terms of the lengthwise direction of the development blade 7, and the entirety of each of the pair of triangular projections 32 of the development blade 7 is within the non-image formation range 5*b*. More concretely, within the image formation range 5*a*, the distance between the metallic supporting plate 7*a* of the development blade 7 and development roller 5, is 2.5 mm, and the triangular projection 32 is positioned so that, in terms of the lengthwise direction of the development blade 7, the base end of the inward edge of the triangular projection 32 coincides with the base end of the outward edge of the elastic member 7*c*. In this embodiment, the distance between the point Q, at which the inward edge of the scraper 8 in terms of the lengthwise direction of the development blade 7 intersects with the inward edge of the triangular projection 32, and the development roller 5 was made to be 1.0 mm.

Figure 19:
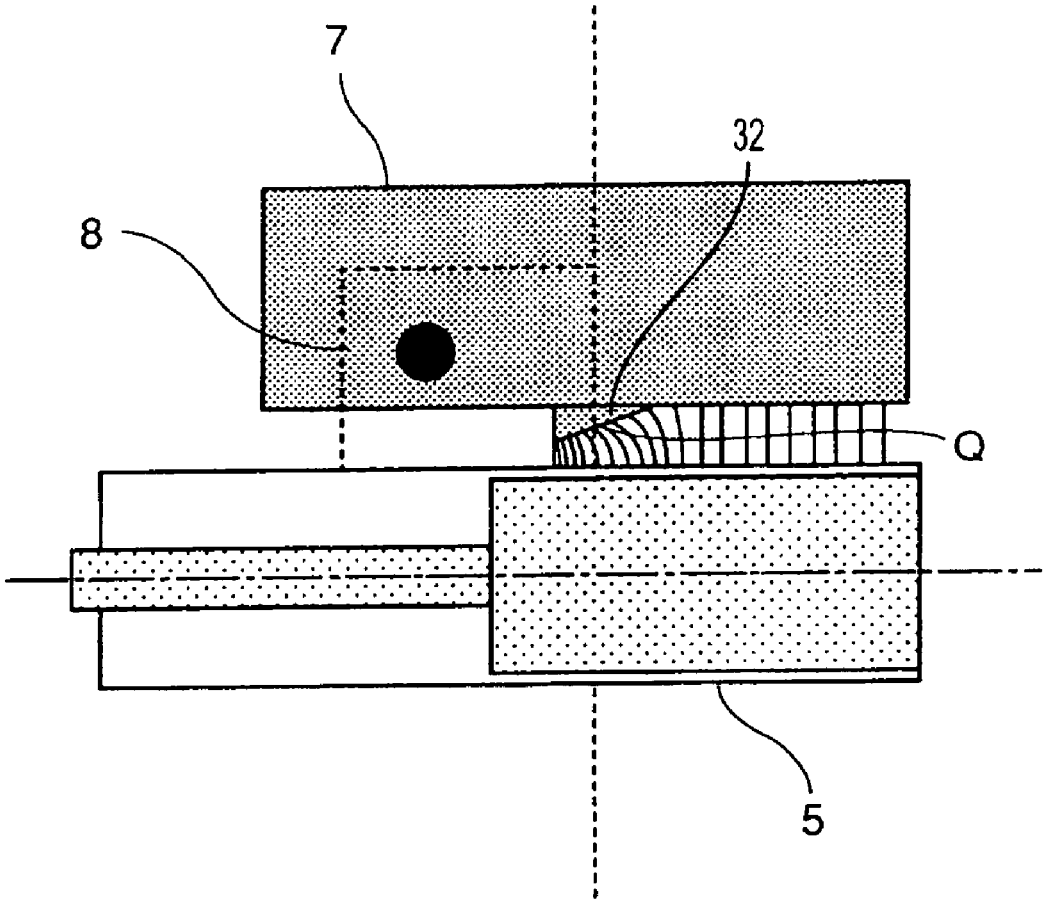
FIG. 19 is a front view of one of the lengthwise end portions of the developing apparatus, for showing the magnetic lines of force.
Figure 20:
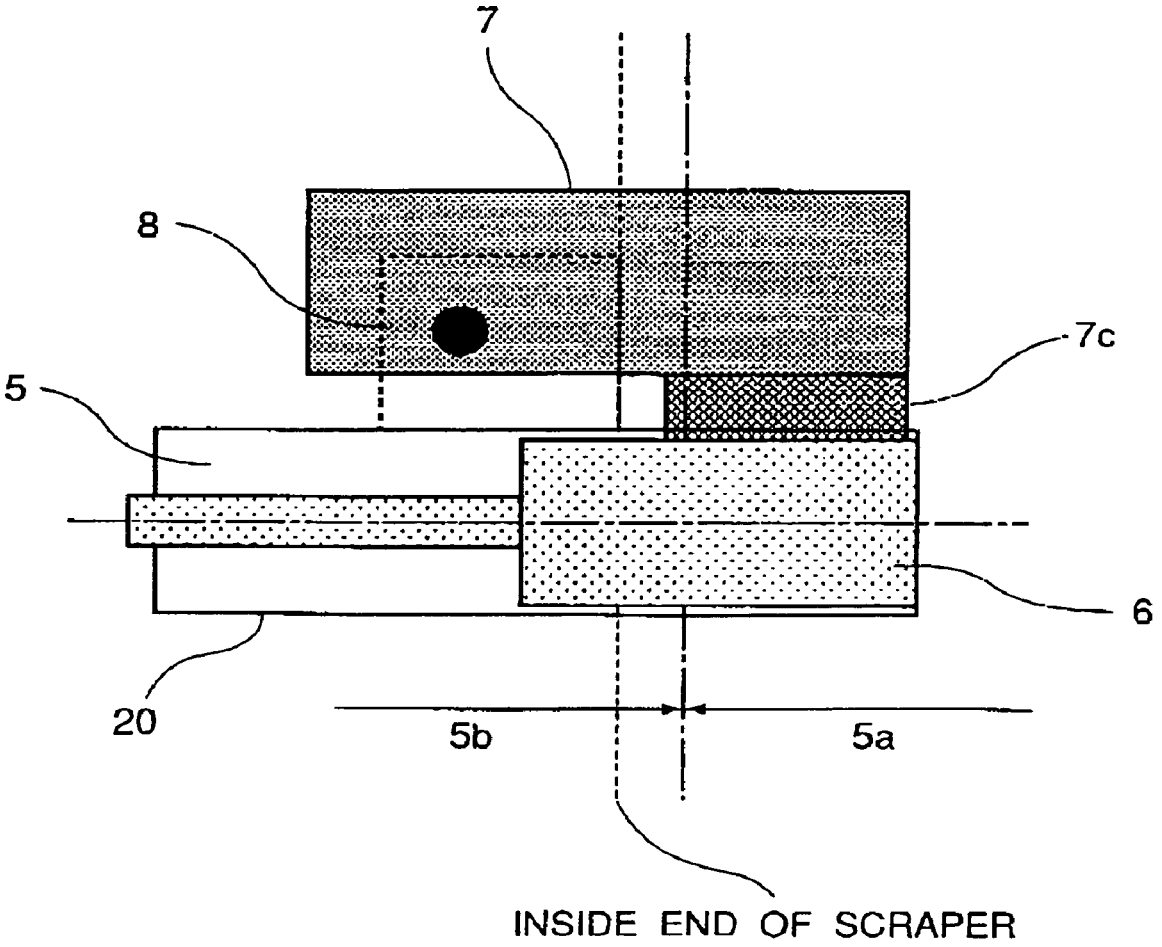
FIG. 20 is a front view of one of the lengthwise end portions of a typical developing apparatus in accordance with the conventional arts, for showing its initial state.
Figure 21:
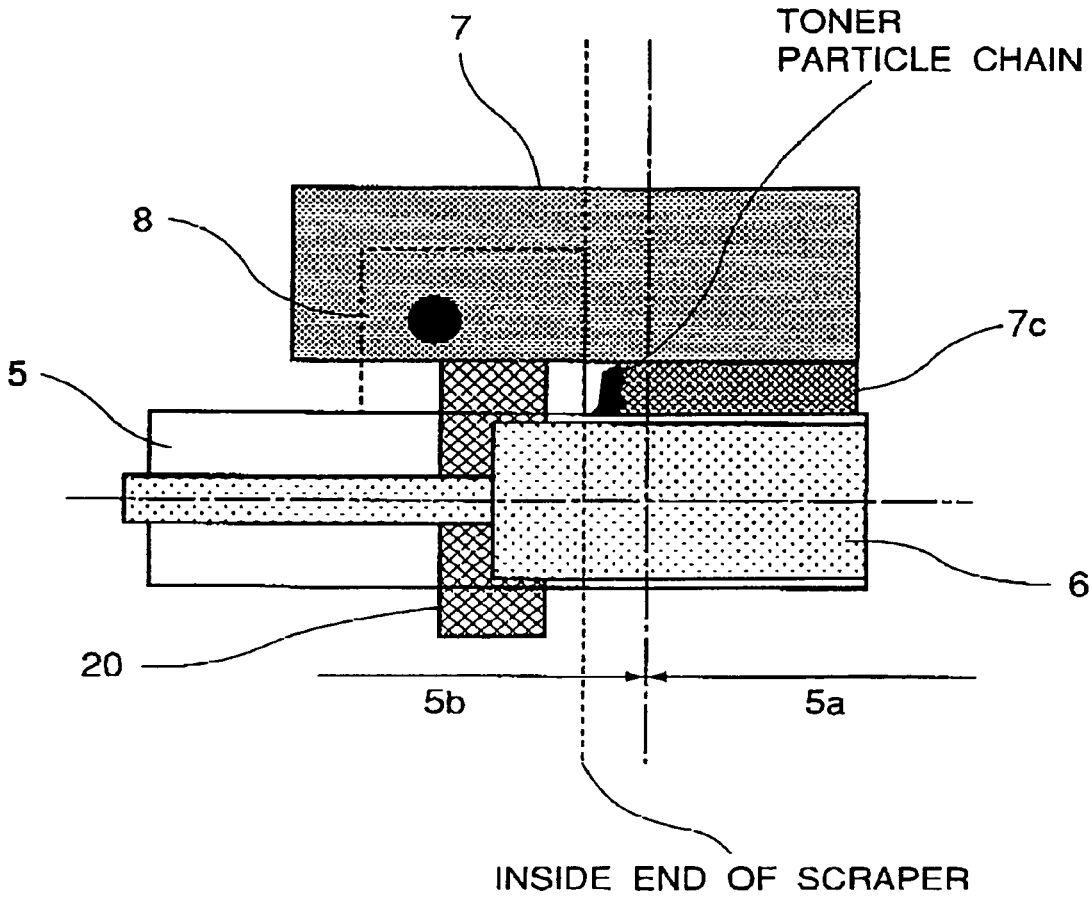
FIG. 21 is a front view of one of the lengthwise end portions of a typical developing apparatus of a conventional type, for showing its state after the production of 3,000 copies.
Figure 22:
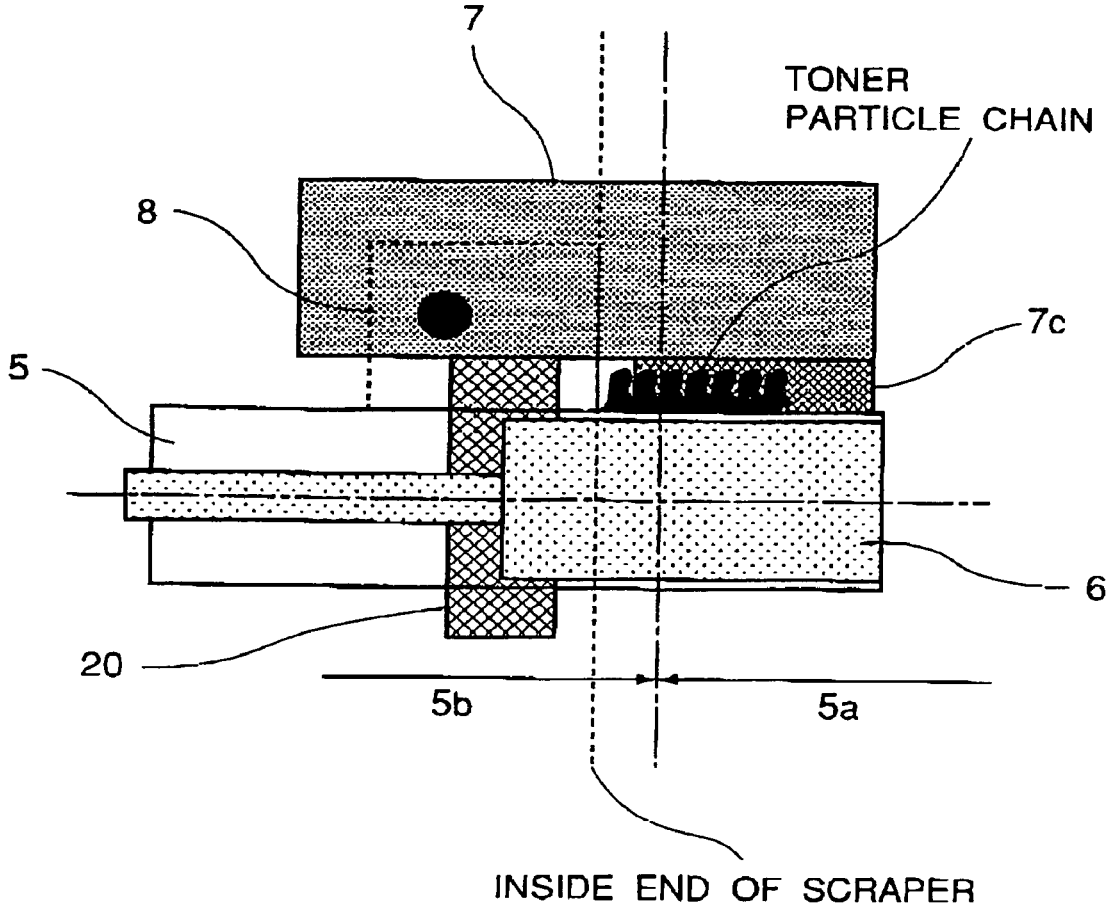
FIG. 22 is a front view of one of the lengthwise end portions of a typical developing apparatus in accordance with the conventional arts, for showing its state after the production of 10,000 copies.

Referring to FIG. 19, which shows the magnetic roller 6 and the magnetic lines of force in the adjacencies of the projection 32, wherein the development blade 7 is provided with the pair of triangular projections 32, the magnetic force from the magnetic roller 6 acts in the lengthwise direction of the development blade 7 (development roller 5), in the adjacencies of each projection 32; it works differently compared to where the development blade 7 is not provided with the pair of triangular projections 32 (FIG. 23). The amount of the magnetic force acting in the lengthwise direction of the development blade 7 at the inward edge of the scraper 8 shown in FIG. 19 was 22 G. In comparison, the magnetic force acting in the lengthwise direction at the inward edge of the scraper 8 shown in FIG. 23 was roughly 2–4 G.

Also in this embodiment, the provision of the pair of scrapers 8 to prevent developer from building up in the non-image formation ranges 5*b* causes developer to build up on the immediately inward side of the inward edge of each scraper 8 and eventually attach to the development blade 7 in the form of an icicle. However, providing the development blade 7 with the pair of triangular projections 32 as described above causes the developer having built up on the immediately inward side of each scraper 8, to be subjected to the strong magnetic force which acts in the lengthwise direction of the development blade 7. In addition, in this embodiment, each triangular projection 32 is shaped and positioned so that the inward edge of the projection 32 will intersect with the inward edge of the corresponding scraper 8. Therefore, it is assured that the developer having built up will be trapped.

In other words, this embodiment also can inexpensively and easily prevent the developer build-up from growing inward of the developing means container 3 in terms of the lengthwise direction of the development roller 5, preventing thereby the formation of a defective image, the defects of which are traceable to the occurrence of the icicling phenomenon in the image formation range 5*a*.

(Experiment)

Figure 18:
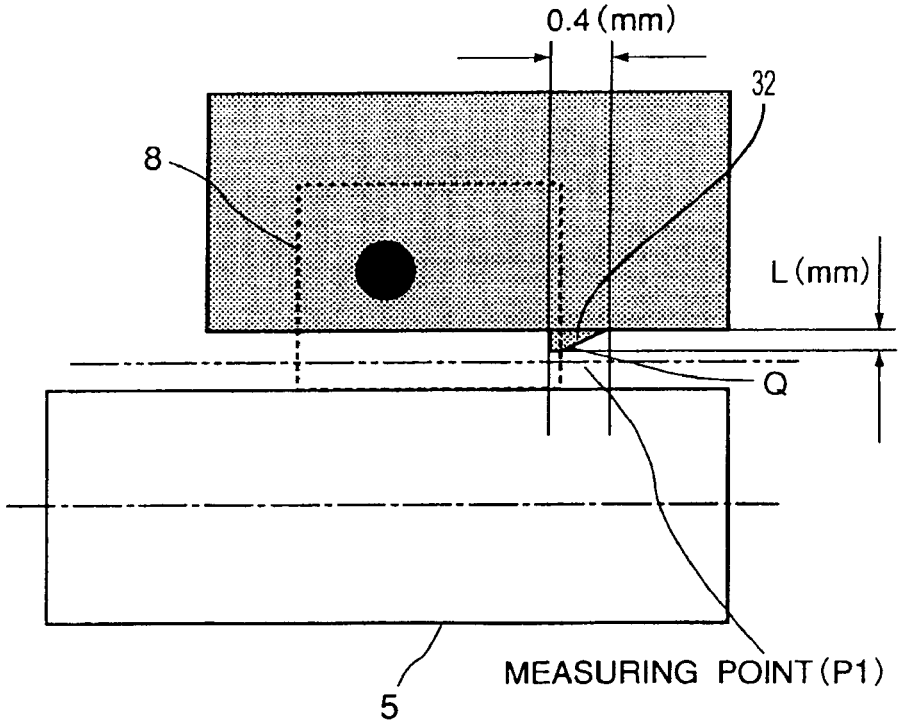
FIG. 18 is a combination of a table and the front view of one of the lengthwise end portions of the developing apparatus, for showing the relationship between the position of the projection of the metallic supporting plate, and the effectiveness of the projection.

Referring to FIG. 18, a plurality of development blades 7 were prepared, which were the same in the dimension of the triangular projection 32, being 0.1 mm, in terms of the lengthwise direction of the development blade 7, and were different in the distance L (mm) by which the point Q of the triangular projection 32, at which the inward edge of the scraper 8, in terms of the lengthwise direction of the development blade 7, intersects with the inward edge of the triangular projection 32, is apart from the edge 7*b* of the metallic supporting member 7*a* of the development blade 7. Then, 10,000 copies were made using each of these development blades 7 to evaluate them in terms of image defectiveness. Referring FIG. 18(*b*), the distance L (mm) is distance between the point Q, at which the inward edge of the scraper 8, in terms of the lengthwise direction of the development blade 7, intersects with the inward edge of the triangular projection 32, and the edge of the metallic plate 7*a*, on the development roller 5 side. Evaluation symbols x and Δ in Table (a) in FIG. 18 mean that the "icicling phenomenon" occurred, and resulted in the formation of a defective image, x indicating that the defects were severe. Evaluation symbols ○ and ◎ mean that the "icicling phenomenon" did not occur, and therefore, a preferable image was obtained, ◎ indicating that an extremely good image was obtained.

Referring to Table (a) in FIG. 18, when the distance L, by which the point Q portion of the triangular projection 32 extended toward the development roller 5, was in the range of 0.5 mm–1.5 mm, preferable images could be obtained. In the case of the development blades 7 which earned the evaluation symbol of ○ or ◎, the amount of the magnetic force acting in the lengthwise direction of the development blade 7, measured at a point P in FIG. 18(*b*) was no less than 16 G.

In other words, as long as the distance L by which the point Q portion of the triangular projection 32, at which the inward edge of the triangular projection 32, in terms of the lengthwise direction of the development blade 7, intersects with the inward edge of the corresponding scraper 8, projects toward the development roller 5 was not less than 0.5 mm, the "icicling phenomenon" did not occur within the image formation range, and therefore, the formation of a defective image, the defects of which are traceable to the circular cresting of developer, did not occur.

As described above, in this embodiment, the development blade 7 is provided with the pair of triangular projections, which extend, one for one, from lengthwise end portions of the edge 7*b* of the metallic supporting member 7*a* of the development blade 7, on the development roller 5 side, toward the development roller 5, and the position of each of which relative to the corresponding scraper 8, in terms of the lengthwise direction of the development blade 7, is such that, in terms of the lengthwise direction of the development blade 7, the inward edge of the projection is on the inward side of the inward edge of the scraper 8. Therefore, in the adjacencies of the inward edge of the projection, the part of the magnetic force from the magnetic roller 6 acts in the direction parallel to the lengthwise direction of the development blade 7. Thus, even if developer builds up on the portion of the peripheral surface of the development roller 5, immediately inward of the inward edge of the scraper 8, the developer build-up is kept in the adjacencies of the inward edge of the scraper, by this part of the magnetic force, being thereby prevented from growing into the image formation range. Therefore, even if developer builds up up on the above described portion of the development roller 5, the developer build-up does not disturb the uniform layer of developer on the development roller 5. Therefore, the problem that a defective image is formed due to the disturbance of the uniform layer of developer, caused by the developer having built up on the portion of the peripheral surface of the development roller 5, immediately inward side of the inward edge of the scraper 8, does not occur.

While the invention has been described with reference to the structures disclosed herein, it is not confined to the details set forth, and this application is intended to cover such modifications or changes as may come within the purposes of the improvements or the scope of the following claims.

What is claimed is:

1. A developing blade member for regulating the thickness of a layer of a developer on a peripheral surface of a rotatable developing roller, enclosing a magnet roller, which is scraped by a scraper scraping the developer toward an inside portion of the developing roller in the longitudinal direction of the developing roller and provided at a longitudinal end of the developing roller, said developing blade member comprising:

an elastic member configured and positioned to regulate a thickness of the layer of the developer on the peripheral surface of the developing roller;

a metal plate configured and positioned to support said elastic member; and two projections, each projecting toward the developing roller and provided at a different longitudinal end of said metal plate, wherein an inside end of one of said projections, with respect to the longitudinal direction of the developing roller, is disposed inward of an inside end of the scraper and in a non-image-formation region of the developing roller.

2. A developing blade member according to claim 1, wherein the direction of a magnetic line of force in the non-image-formation region inward of the inside end of the scraper, generated by the magnet roller, contains a component parallel to the longitudinal direction of said metal plate.

3. A developing blade member according to claim 2, wherein the parallel component of the magnetic line of force has an intensity of not less than 15 G.

4. A developing apparatus for developing an electrostatic latent image formed on an image bearing member with a developer, said apparatus comprising:

a rotatable developing roller enclosing a magnet roller, configured and positioned to develop the electrostatic latent image;

a developing blade configured and positioned to regulate a thickness of the layer of the developer on a peripheral surface of said developing roller; and a scraper configured and positioned to scrape the developer toward an inside portion of said developing roller in the longitudinal direction of said developing roller, said scraper being provided at a longitudinal end of said developing roller;

wherein said developing blade includes:

an elastic member configured and positioned to regulate the thickness of the layer of the developer on the peripheral surface of said developing roller;

a metal plate configured and positioned to support said elastic member; and two projections, each projecting toward said developing roller, and each provided at a different longitudinal end of said metal plate, wherein an inside end of one of said projections, with respect to the longitudinal direction of the developing roller, is disposed inward of an inside end of said scraper and in a non-image-formation region of said developing roller.

5. A developing apparatus according to claim 4, wherein the direction of a magnetic line of force in the non-image-formation region inward of the inside end of said scraper, generated by the magnet roller, contains a component parallel to the longitudinal direction of said metal plate.

6. A developing apparatus according to claim 5, wherein the parallel component of the magnetic line of force has a magnetic intensity of not less than 15 G.

7. A process cartridge according to claim 4, wherein the direction of a magnetic line of force in the non-image-formation region inward of the inside end of the scraper, generated by the magnet roller, contains a component parallel to a longitudinal direction of said metal plate.

8. A process cartridge according to claim 7, wherein the parallel component of the magnetic line of force has a magnetic intensity of not less than 15 G.

9. A process cartridge detachably mountable to an image forming apparatus, said process cartridge comprising:

an image bearing member;

a rotatable developing roller enclosing a magnet roller, configured and positioned to develop an electrostatic latent image formed on said image bearing member; and a developing blade configured and positioned to regulate a thickness of the layer of the developer of the peripheral surface of said developing roller, said developing blade including:

an elastic member configured and positioned to regulate the thickness of the layer of the developer on the peripheral surface of said developing roller;

a metal plate configured and positioned to support said elastic member; and two projections, each projecting toward said developing roller, said projection and being provided at a different longitudinal end of said metal plate, wherein an inside end of one of said projections, with respect to the longitudinal direction of said developing roller, is disposed inward of an inside end of said scraper and in a non-image-formation region of said developing roller.

* * * * *

UNITED STATES PATENT AND TRADEMARK OFFICE

CERTIFICATE OF CORRECTION

PATENT NO. : 6,963,714 B2
APPLICATION NO. : 10/702445
DATED : November 8, 2005
INVENTOR(S) : Yasunao Otomo et al.

It is certified that error appears in the above-identified patent and that said Letters Patent is hereby corrected as shown below:

COLUMN 1
Line 19, “apparatus” should read --apparatus.--.

COLUMN 2
Line 54, “above” should read --above- --.
Line 66, “above described” should read -- above-described--.

COLUMN 3
Line 3, “above” should read --above- --.

COLUMN 7
Line 2, “tow” should read --too--.

COLUMN 9
Line 16, “above described” should read --above-described--.
Line 24, “above described” should read --above-described--.

COLUMN 13
Line 15, “up (second occurrence) should be delete.
Line 16, “above described” should read --above described--.

COLUMN 14
Line 56, “said projection” should be deleted.

Signed and Sealed this

Twenty-ninth Day of August, 2006

JON W. DUDAS
*Director of the United States Patent and Trademark Office*